US006728982B2

(12) United States Patent
Lemire et al.

(10) Patent No.: US 6,728,982 B2
(45) Date of Patent: May 4, 2004

(54) PEDIATRIC STRETCHER

(75) Inventors: Guy Lemire, Beaumont (CA); Michel Robitaille, St-Pacome (CA)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 10/212,422

(22) Filed: Aug. 5, 2002

(65) Prior Publication Data

US 2003/0028966 A1 Feb. 13, 2003

Related U.S. Application Data

(60) Provisional application No. 60/311,269, filed on Aug. 9, 2001.

(51) Int. Cl.[7] ..... A47D 7/02
(52) U.S. Cl. ..... 5/603; 5/626; 5/428; 5/100
(58) Field of Search ..... 5/428, 429, 430, 5/425, 100, 603, 626

(56) References Cited

U.S. PATENT DOCUMENTS

| | | | | |
|---|---|---|---|---|
| 2,640,203 | A | | 6/1953 | Sheldon |
| 3,299,450 | A | | 1/1967 | Gottfried et al. |
| 3,583,006 | A | | 6/1971 | Oehms |
| D227,626 | S | | 7/1973 | Ferguson |
| 3,780,387 | A | | 12/1973 | Propst |
| D232,279 | S | | 8/1974 | White |
| 3,921,233 | A | * | 11/1975 | Mann ..... 5/97 |
| 3,932,903 | A | | 1/1976 | Adams et al. |
| 4,612,679 | A | | 9/1986 | Mitchell |
| D289,714 | S | | 5/1987 | Toffolo |
| 4,752,977 | A | | 6/1988 | Smith et al. |
| D300,997 | S | | 5/1989 | Simpkins et al. |
| 4,825,484 | A | * | 5/1989 | Riegel ..... 5/97 |
| 4,930,819 | A | * | 6/1990 | Sharp et al. ..... 292/42 |
| 5,016,926 | A | * | 5/1991 | Sharp et al. ..... 292/42 |
| 5,485,699 | A | * | 1/1996 | Gabhart ..... 49/394 |
| 5,511,257 | A | * | 4/1996 | Hannes ..... 5/100 |
| 5,742,959 | A | * | 4/1998 | Froelich ..... 5/93.1 |
| 6,339,855 | B1 | * | 1/2002 | Socha et al. ..... 5/93.1 |
| 6,446,283 | B1 | * | 9/2002 | Heimbrock et al. ..... 5/425 |

* cited by examiner

*Primary Examiner*—Heather Shackelford
*Assistant Examiner*—Lisa M. Saldano
(74) *Attorney, Agent, or Firm*—Flynn, Thiel, Boutell & Tanis, P.C.

(57) ABSTRACT

A pediatric stretcher includes a base unit, attached to which are a number of lift assemblies. A frame is supported by the lift assemblies. Attached to the frame is a patient support deck. A railing is coupled to the frame by a plurality of coupling members and is configured to surround the patient support deck. The railing includes four individual rails, including a front rail, a rear rail, a left rail and a right rail. At least one of the four rails is configured to be raised and lowered with respect to the patient support deck and the plurality of coupling members. At least one of the four rails includes a gate that can pivot about a pivot axis. The gate is configured to be released and locked along the pivot axis.

33 Claims, 15 Drawing Sheets

PEDIATRIC STRETCHER

This application claims the benefit of provisional application Ser. No. 60/311,269, filed Aug. 9, 2001.

FIELD OF THE INVENTION

This invention relates generally to pediatric stretchers and, more particularly, to pediatric stretchers having four individual rail members, at least one of which includes a gate that is locked and released along its pivot axis.

BACKGROUND OF THE INVENTION

Pediatric stretchers, or cribs, having various features have been developed for hospital use. Traditional pediatric cribs include a railing that surrounds the patient support deck and the mattress The railing can be a single unit that is raised and lowered as one piece. More commonly, the railing includes two, three or even four separate rail units. For instance, the railing might include an individual rail unit adjacent each side of the patient support deck. One or more of these rail units is capable of being raised and lowered with respect to the patient support deck. In addition, a gate is commonly provided on at least one side of contemporary pediatric cribs to allow access to the patient without the need to lower the railing.

Most pediatric stretchers today include one or more safety features to prevent a precocious patient from lowering a railing, opening a gate or otherwise endangering themselves. For instance, it is common for the mechanism to open a gate or lower a rail to include multiple buttons, levers, etc. that must be moved in unison to unlatch the component. While features such as these decrease the likelihood that a child will injure themselves on the stretcher, they can also interfere with use by a parent, nurse or other caregiver. For example, when a caregiver holding the patient desires to return the child to the crib, they often need two hands to open a gate or lower a rail to make the stretcher accessible. Thus, they must choose between putting the child down, a sometimes impractical or impossible choice, or holding the child in an awkward or unsafe manner, in order to access the stretcher mattress.

In addition to these concerns, it is common for pediatric patients to have one or more tubes or wires connecting them to intravenous (iv) fluid and/or medicine dispensers, monitoring equipment and other apparatuses. If the railing of the crib does not provide one or more openings for tube or wires to pass, the caregiver must choose between lowering the railing until it is flush with the mattress or unhooking the wires and/or tubes and reattaching them once the child is back in the crib.

SUMMARY OF THE INVENTION

This invention is directed to a new and useful pediatric stretcher. The pediatric stretcher includes a base unit that includes a number of lift assemblies. The lift assemblies are connected to a frame. The frame supports a patient support deck. A railing is coupled to the frame by a plurality of coupling members and is configured to surround the patient support deck. The railing includes four individual rails, including a front rail, a rear rail, a left rail and a right rail. At least one of the four rails is configured to be raised and lowered with respect to said patient support deck and the plurality of coupling members. At least one of the four rails includes a gate that can pivot about a pivot axis. The gate is configured to be released and locked along the pivot axis.

BRIEF DESCRIPTION OF THE DRAWINGS

This invention is pointed out with particularity in the accompanying claims. The above and further features and benefits of this invention are better understood by reference to the following detailed description, as well as by reference to the following drawings in which:

DETAILED DESCRIPTION

Figure 1:
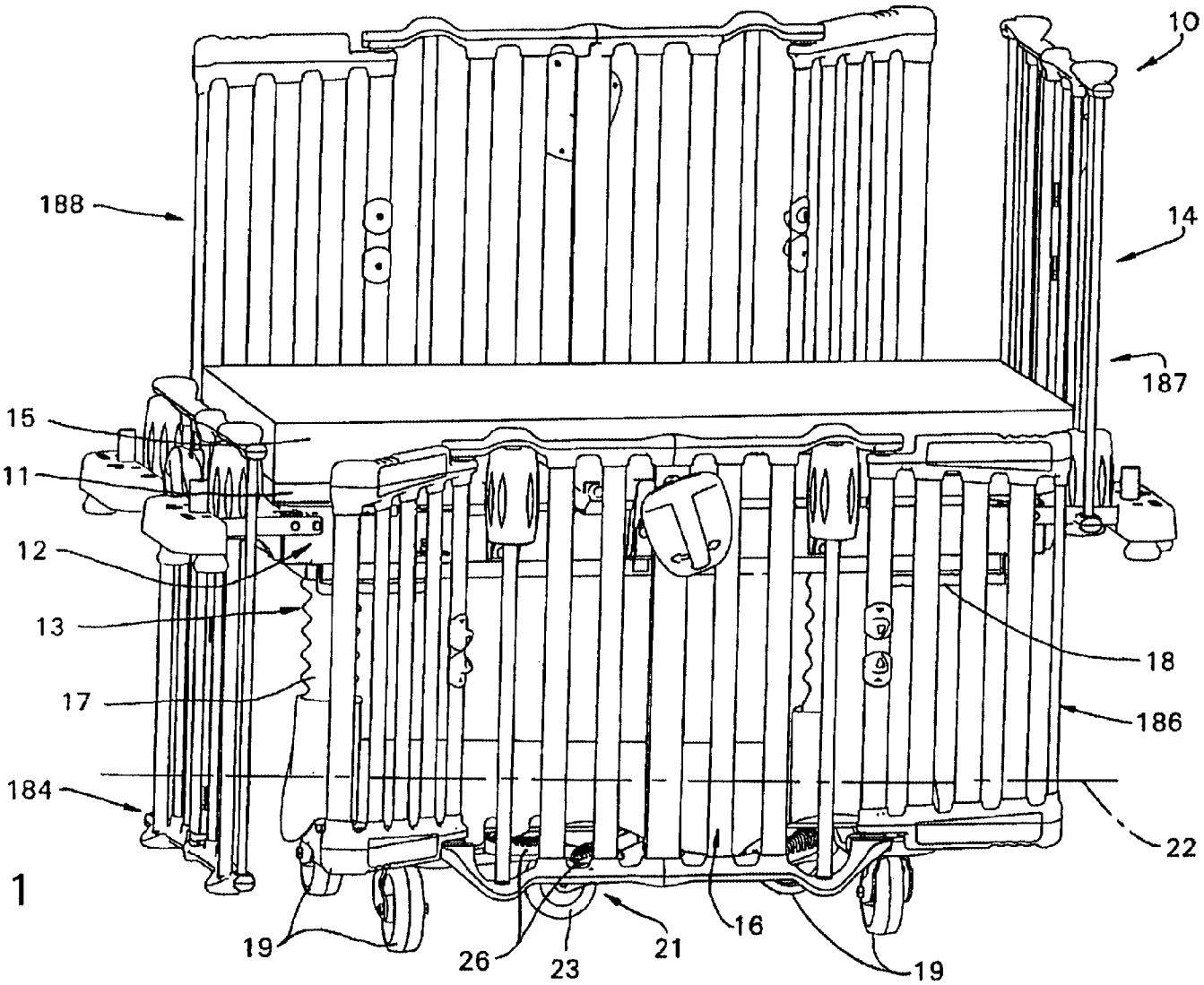
FIG. 1 is a front view of a pediatric stretcher according to this invention.

Referring to FIG. 1 a pediatric stretcher 10 is illustrated according to this invention. The pediatric stretcher 10 is supported by a wheeled base unit 16. A lift assembly 13 connects the wheeled base unit 16 to a frame 12. The frame 12 supports a patient support deck 11. Positioned atop the patient support deck 11 is a mattress 15. The patient support deck 11 and the mattress 15 are surrounded by a railing 14.

A plurality of castered wheels 19 are provided on the wheeled base unit 16 at the four corners thereof defining a theoretical polygon, depicted herein as a rectangle. An auxiliary fifth wheel mechanism 21 is provided on the wheeled base unit 16 and is oriented so that its plane of rotation is fixed and parallel to a longitudinal axis 22 of the wheeled base unit 16. The fifth wheel mechanism 21 includes an auxiliary wheel 23 and a support structure (not shown) for connecting the wheel 23 to the wheeled base unit 16. Three pedals 26 extend from the wheeled base unit 16 and allow a caregiver to lock and unlock the wheels 19. A pair of hydraulically operated jacks 17, constituting the lift assembly 13, are interposed between the wheeled base unit 16 and the frame 12. Each jack 17 is mounted to the wheeled base unit 16 and is fixedly secured in place by brackets 18. At least one of the pedals 26 allow a caregiver to control the jacks 17. All of the above structure is conventional and forms the environment for the invention, which will be discussed in detail below. Therefore, further detail of the above components will not be provided.

Figure 2A:
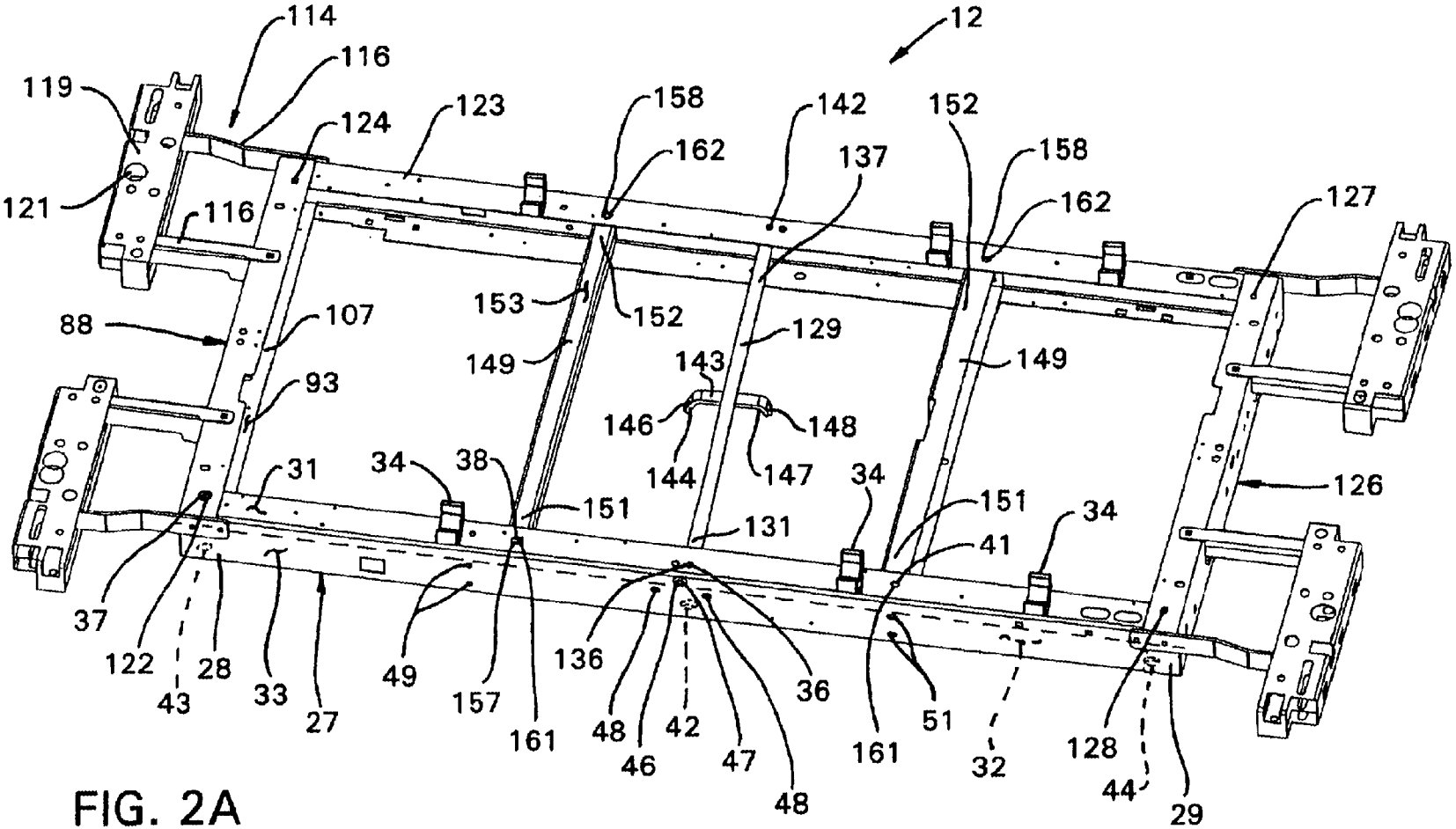
FIG. 2A is an elevated front isometric view of the frame portion of the pediatric stretcher of FIG. 1.
Figure 2B:
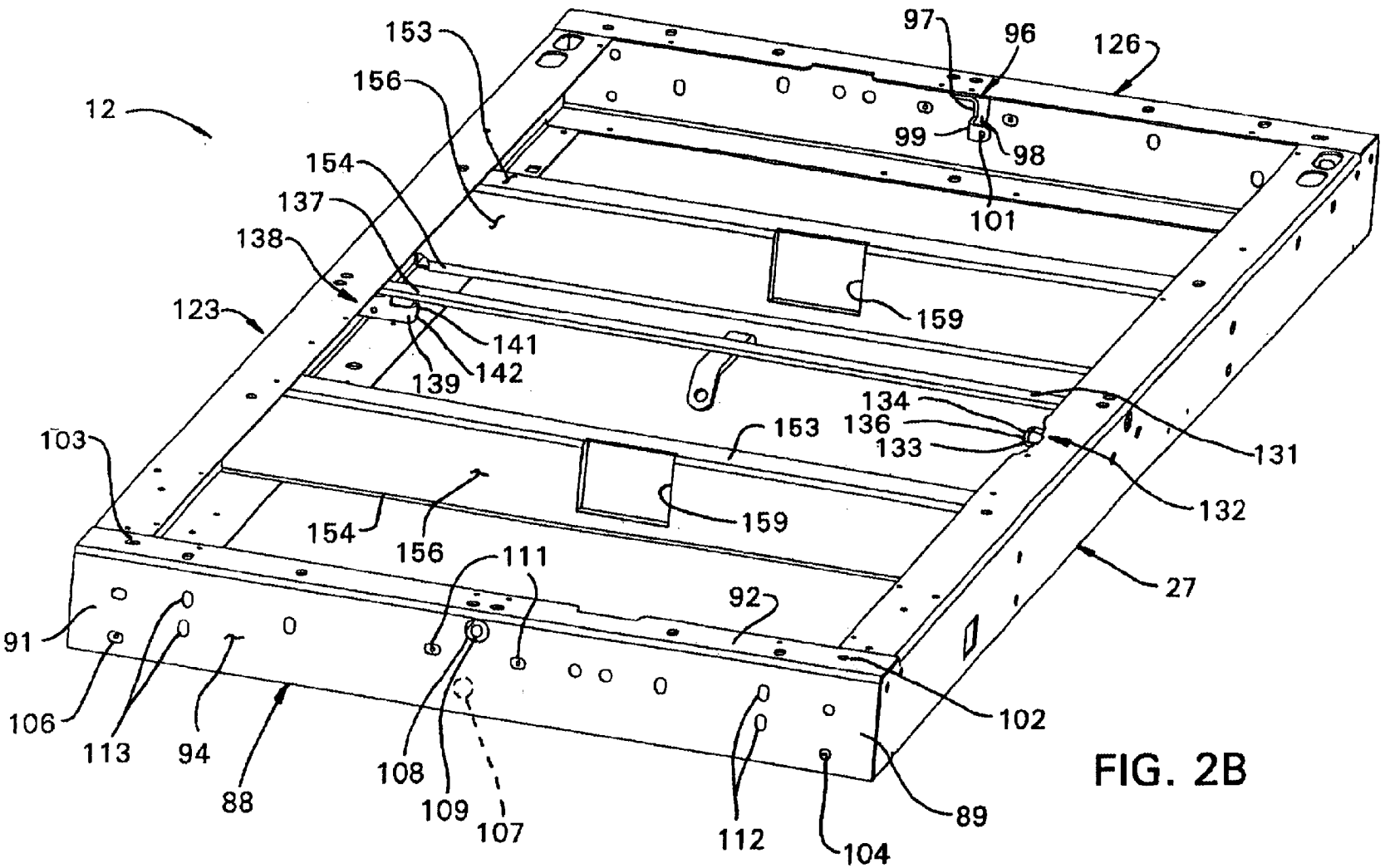
FIG. 2B is an elevated side isometric view of the frame portion of the pediatric stretcher of FIG. 1.

The patient support deck 11 is supported by the frame 12. Referring now to FIGS. 2A and 2B, the frame 12 includes a front frame member 27 having a rectangular profile. The front frame member 27 has a first end 28 and a second end 29 and extends substantially the length of the pediatric stretcher 10. The front frame member 27 is generally U-shaped and has a top surface 31 and a bottom surface 32 that are separated by a side surface 33. A number of brackets 34 are fixedly attached to an outer facing surface of the top surface 31.

A number of bores extend through the top surface 31 of the front frame member 27. In particular, a bore 36 extends through the top surface 31 near the center of the front frame member 27. Extending through the top surface 31 at the first end 28 of the front frame member 27 is a bore 37. A bore 38 extends through the top surface 31 between the central bore 36 and the bore 37. A bore 39 extends through the top surface 31 at the second end 29 of the front frame member 27. Finally, a bore 41 extends through the top surface 31 between the central bore 36 and the bore 39.

A series of bores also extend through the bottom surface 32 of the front frame member 27. A bore 42 extends through the bottom surface 32 near the center of the front frame member 27. A bore 43 extends through the bottom surface 32 at the first end 28 and is axially aligned with the bore 37 extending through the top surface 31. A bore 44 extends through the bottom surface 32 at the second end 29. The bore 44 is axially aligned with the bore 39 that extends through the top surface 31.

With reference to the side surface 33, a bore 46 extends through the mid-point of the front frame member 27. Preferably, a rubber insert 47 including a central opening is positioned in the bore 46. A pair of bores 48 extend through the side surface 33 on either side of the bore 46. A first pair of longitudinally aligned bores 49 extend through the side surface 33 and are positioned between the central bore 46 and the first end 28. A second pair of longitudinally aligned bores 51 extend through the side surface 33 and are disposed between the central bore 46 and the second end 29.

Figure 3:
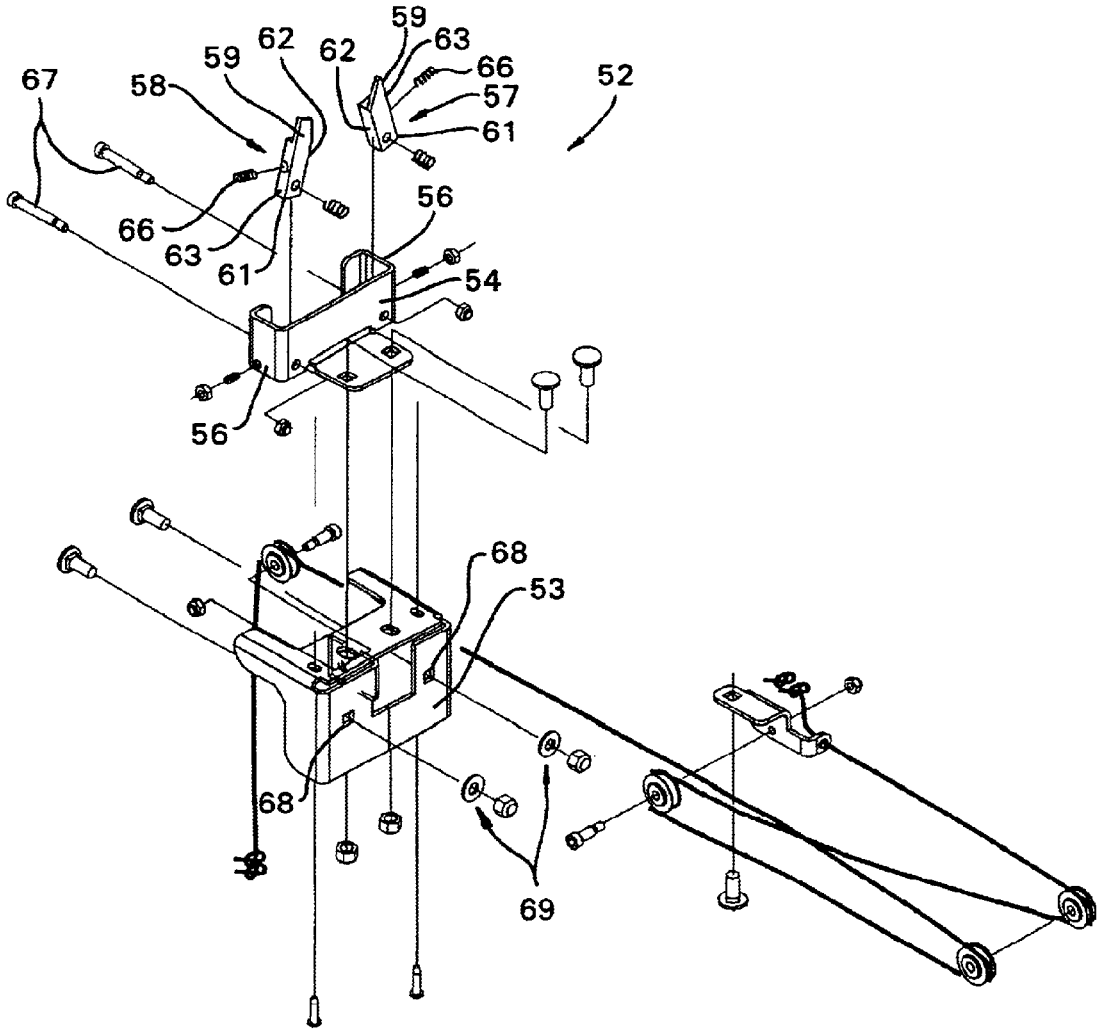
FIG. 3 is an assembly view of one of the brackets attached to the frame of FIGS. 2A–2B.
Figure 5:
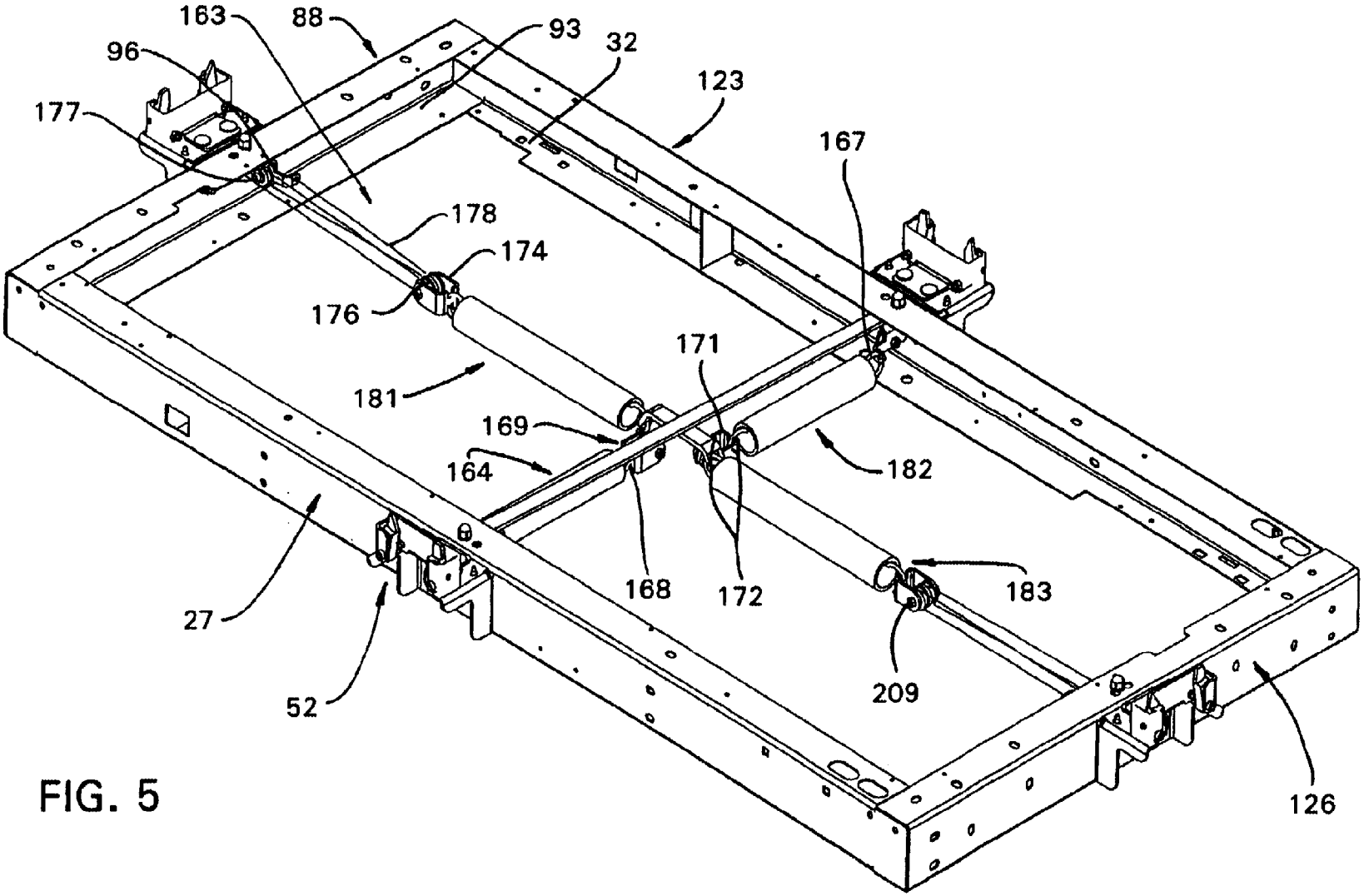
FIG. 5 is an elevated view of the counterbalance system of the pediatric stretcher of FIG. 1.

A bracket 52 is secured to an outer-facing surface of the side surface 33 on the central portion of the front frame member 27 as illustrated in FIG. 5. The bracket 52, illustrated in more detail in FIG. 3, includes a flat portion 53 that is attached to a sleeve portion 54. The sleeve 54 includes a pair of arms 56. Positioned within the left arm 56 is a left hinged latch 57. Positioned within the right arm 56 is a right hinged latch 58. Due to the similarities between the left latch 57 and the right latch 58, like reference numbers will be used to indicate like components or features. Each of the hinged latches 57–58 has a top portion 59 and a bottom portion 61. Each hinged latch 57–58 has an inner surface 62 that is oriented in opposition to its respective arm 56. Each hinged latch 57–58 also has an outer 63 surface that is adjacent its respective arm 56.

The top portion 59 of each latch 57–58 does not extend the full width of the bottom portion 61. In other words, the width of the each latch 57–58 at the top portion 59 is about one half of the width of the respective latch 57–58 at the bottom portion 61. The uppermost surface of each bottom portion 61 forms a curved ledge 64 (best illustrated in FIG. 6A) in front of each top portion 59. The top portion 59 of the left latch 57 is configured differently than the top portion 59 of the right latch 58. The top portion 59 of the left latch 57 is slanted toward the center of the sleeve portion 54. The top portion 59 of the right latch 58 is a generally flat, planar surface.

A spring 66 connects the outer surface 63 of each of the latches 57–58 to the bracket arms 56. Each spring 66 is biased to urge the respective latch 57–58 away from the respective arm 56. Extending through the bottom portion 61 of each latch 57–58 is a pin 67 that attaches the latch 57–58 to the flat portion 53 of the bracket 52. Each latch 57–58 is configured to pivot about its pin 67 against the urging of the respective spring 66 when a sufficient force is exerted on the top portion 59. When no such force is exerted on the top portion 59, the latch 57–58 can pivot about the pin 67 in the direction of the urging of the spring 66.

Returning to the bracket 52, two bores 68 extend through the flat portion 53 and are positioned on either side of a mid-point of the flat portion 53. A nut and bolt assembly 69 extends through each bore 68. Each nut and bolt assembly 69 also extends through a respective bore 48 in the side surface 33 to secure the bracket 53 to front frame member 27.

Figure 4A:
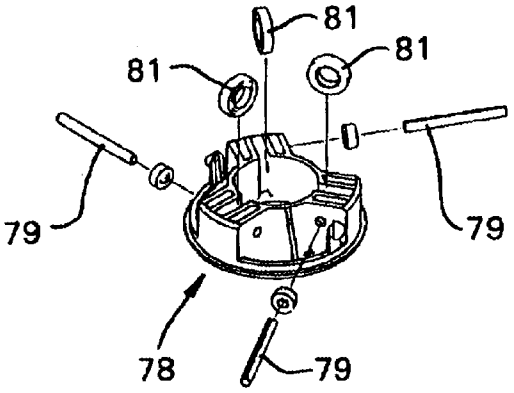
FIG. 4A is an assembly view of the lower bracket of the bushing of FIG. 4.
Figure 4:
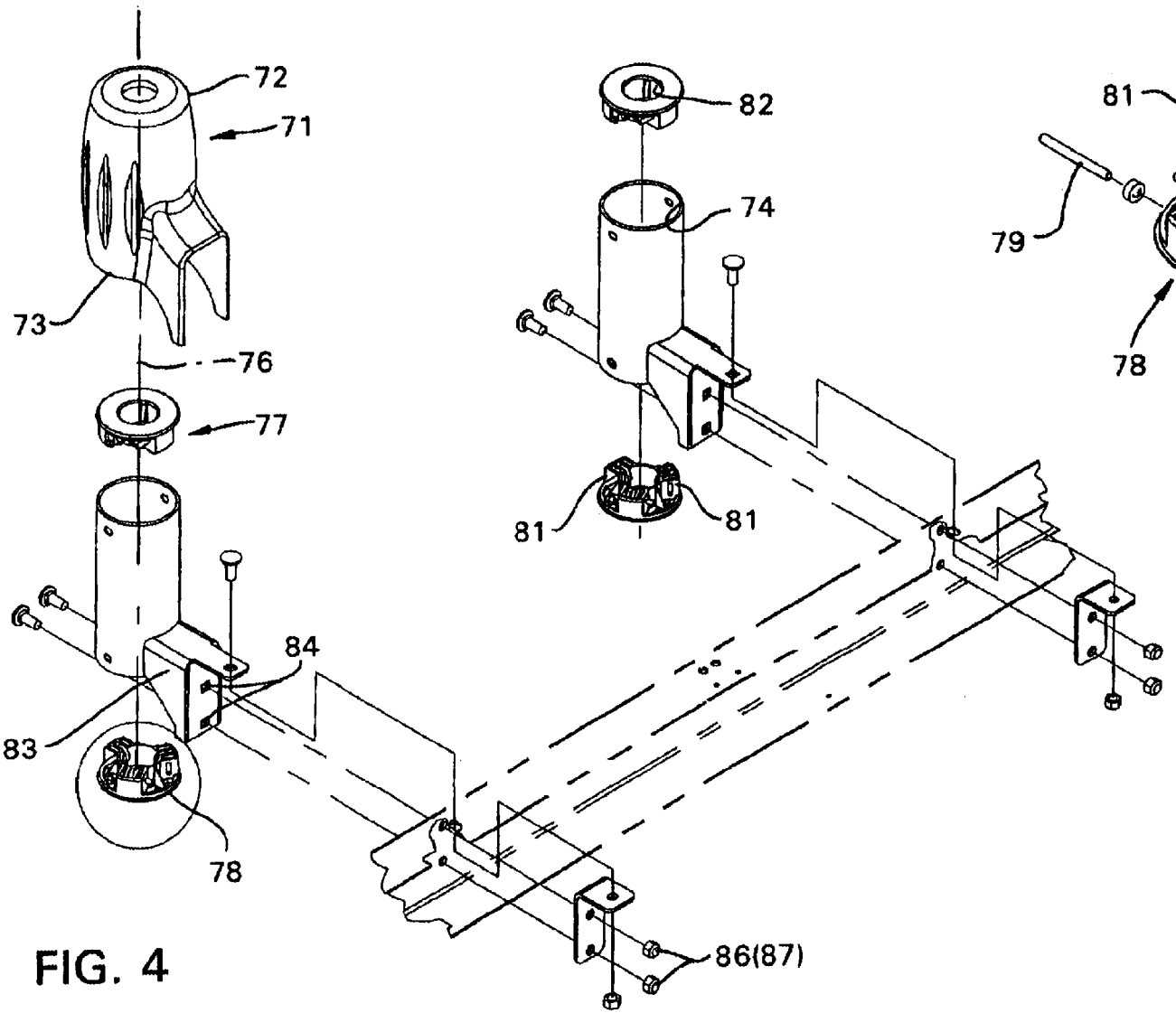
FIG. 4 is an assembly view of one of the bushings attached to the frame of FIGS. 2A–2B.

Two bushings 71 are also secured to the outer-facing surface of the side surface 33 of the front frame member 27. Referring to FIG. 4, each bushing 71 includes an upper end 72 and a lower end 73. Each bushing 71 has an opening 74 that is centered about a longitudinal axis 76. Referring in addition to FIG. 4A, a bracket 77 is positioned within the opening 74 of the bushing 71 at the upper end 72. Positioned within the opening 74 of the bushing 71 at the lower end 73 is a bracket 78. Each bracket 77–78 is configured to receive three pins 79 that are equally spaced about a longitudinal axis 76 of the bushing 71. Each pin 79 supports a roller 81. Each of the brackets 77–78 define a central opening 82 that is centered about the longitudinal axis 76. Preferably, the lower bracket 78 is off-set from the upper bracket 77 by 60° about the longitudinal axis 76. Thus, each roller 81 on the upper bracket 77 will be off-set about the longitudinal axis 76 from a roller 81 on the lower bracket 78 by 60°.

Returning to FIG. 4, a bracket 83 is attached to the outer surface of the bushing 71 near the lower end 73. A pair of longitudinally aligned bores 84 extend through the bracket 83. A nut and bolt assembly 86 is inserted through each bore 84 of the bracket 83 and each bore 49 of the side surface 33 to secure one of the bushings 71 to the front frame member 27. Likewise, a nut and bolt assembly 87 is inserted through each of the bores 84 of the bracket 83 and each bore 51 of the side surface 33 to secure the second bushing 71 to the front frame member 27.

The frame 12 (FIG. 2B) includes a left frame member 88. The left frame member 88 has a rectangular profile and has a length that is substantially the width of the pediatric stretcher 10. The left frame member 88 has a first end 89 and a second end 91. The left frame member 88 is a generally U-shaped member and includes a top surface 92 that is separated from a bottom surface 93 (FIG. 2A) by a side surface 94. A bracket 96 is suspended from the center of the top surface 92 that extends downward toward the base unit 16. The bracket 96 includes a first arm 97 that extends away from the left frame member 88. A first bore 98 extends through the first arm 97. A second arm 99 is oriented at a right angle with respect to the first arm 97. A second bore 101 extends through the second arm 99.

A bore 102 extends through the top surface 92 at the first end 89 of the left frame member 88. Extending through the top surface 92 at the second end 91 is a bore 103. A bore 104 extends through the first end 89 of the bottom surface 93 and is axially aligned with the bore 102 extending through the top surface 92. A bore 106 extends through the second end 91 of the bottom surface 93 and is axially aligned with the bore 103 that extends through the top surface 92. A bore 93 extends through the bottom surface 93 near the mid-point of the left frame member 74.

A number of bores extend through the side surface 94 of the left frame member 88. In particular, a bore 108 extends through the side surface 94 near the mid-point of the left frame member 88. Preferably, a rubber insert 109 including a central opening is positioned in the bore 108. Two bores 111 extend through the side surface 91 near the center of the left frame member 88 on either side of the bore 108. A first pair of longitudinally aligned bores 112 extend through the side surface 94 and are disposed between the central bore 111 and the first end 89. A second pair of longitudinally aligned bores 113 extend through the side surface 94 of the left frame member 88 and are located between the central bore 111 and the second end 91.

A bracket 52 (FIG. 5) is secured to an outer-facing surface of the side surface 94 of the left frame member 88. The bracket 52 is identical to the bracket 52 described above and attached to the front frame member 27. A nut and bolt assembly 69 extends through the each bore 68 of the bracket 52 and each bore 111 to secure the bracket 52 to left frame member 88.

Attached to the outer-facing surface of the side surface 94 are a pair of brackets 114 (FIG. 2A). The brackets 114 each include a pair of spaced apart arms 116 that extend away from the side surface 94.

Each of the brackets 114 supports a pedestal 119. Thus, two pedestals 119 are attached to the left frame member 88. The spaced apart arms 116 are attached to the pedestals 119 in a conventional manner. For instance, while not illustrated, the arms 116 could be attached to the pedestal 119 by nut and bolt assemblies. Each pedestal 119 has a generally rectangular shape. A number of bores 121 extend through the each pedestal 119. Alternatively, the bores 121 could be replaced by pockets that are defined by the upper surface of the pedestal 119. The pedestal 119 could be used to support an iv pole that is inserted into one of the bores 121.

Two bushings 71, identical to those described above, are attached to the side surface 94. A first bushing 71 is positioned on the left frame member 88 such that each of the bushing bores 84 is axially aligned with the bores 112 of the left frame member 88. A nut and bolt assembly 86 is inserted through each bore 112 and 84 to secure the bushing 71 to the left frame member 88. A second bushing 71 is secured to the left frame member 88 such that each of the bushing bores 84 is axially aligned with the bores 113. A nut and bolt assembly 87 is inserted through each of the bores 113 and 84 to secure the bushing 71 to the left frame member 88. Since each bushing 71 is positioned between the arms 116 of the bracket 114, the arms 116 should be sufficiently long to allow the bushing 71 to fit between the pedestal 119 and the side surface 94 of the left frame member 88.

The first end 89 of the left frame member 88 is sized to receive the first end 28 of the front frame member 27. When the frame components 28 and 88 are assembled, the bores 37 and 43 in the top and bottom surfaces 31 and 32 of the front frame member 27 are aligned with the bores 102 and 104 in the top and bottom surfaces 92 and 93 of the left frame member 88. A nut and bolt assembly 122 is inserted through the bores 37, 43, 102 and 104 to secure the front frame member 27 to the left frame member 88.

The frame 12 includes a rear frame member 123 that has a rectangular profile and extends substantially the length of the pediatric stretcher 10. The rear frame member 123 is virtually identical to the front frame member 27, thus, a detailed description will not be provided. Those components and features of the rear frame member 123 that are identical to complementary components and features of the front frame member 27 will be identified by the reference numbers utilized in the description of the front frame member 27. The rear frame member 123 has a first end 28 and a second end 29. The rear frame member 123 is U-shaped and has a top surface 31 that is separated from a bottom surface 32 by a side surface 33. A number of brackets 34 are fixedly secured to an outer-facing surface of the top surface 31. A number of bores extend through the top, bottom and side surfaces 31–33 and are oriented as described for the front frame member 27.

A bracket 52 (FIG. 5) is secured to an outer-facing surface of the side surface 33 of the rear frame member 123. The bracket 52 is identical to the brackets 52 described above and is attached to the rear frame member 123 in the same manner as indicated for the front frame member 27. Similarly, two bushings 71, identical to those described above, are attached to the rear frame member 123. The bushings 71 are oriented as indicated above and are attached as described for the bushings 71 attached to the front frame member 27.

The second end 29 of the rear frame member 123 is sized to be received by the second end 91 of the left frame member 88. The rear frame member 123 and the left frame member 88 are oriented such that the bores 103 and 106 of the left frame member 88 are axially aligned with the bores 39 and 44 of the rear frame member 123. The rear frame member 123 is secured to the left frame member 88 by a nut and bolt assembly 124 that is inserted through the bores 103, 106, 39 and 44.

The fourth member of the frame 12 is a right frame member 126. The right frame member 126 is virtually identical to the left frame member 88, thus, a detailed description will not be provided. Those components and features of the right frame member 126 that are identical to complementary components and features of the left frame member 88 will be identified by the reference numbers utilized in the description of the left frame member 88. The right frame member 126 has a first end 89 and a second end 91. The right frame member 126 is U-shaped and has a top surface 92 that is separated from a bottom surface 93 by a side surface 94. A bracket 96 is suspended from the top surface 92 of the right frame member 126. A number of bores extend through the top, bottom and side surfaces 92–94 and are oriented as described for the left frame member 88.

A bracket 52 (FIG. 5) is secured to an outer-facing surface of the side surface 94 of the right frame member 126. The bracket 52 is identical to the brackets 52 described above and attached to the front, left and rear frame members 27, 88 and 123. Thus, a detailed description will not be provided. Attached to the side surface 142 are a pair of brackets 114. The brackets 114 are identical to the brackets 114 attached to the left frame member 88. Each of the brackets 114 supports a pedestal 119. Therefore, two pedestals 119 are attached to the right frame member 126. The pedestals 119 are identical to the pedestals 119 that are attached to the left frame member 88.

Two bushings 71, identical to those described above, are attached to the outer-facing surface of the side surface 142. While a detailed description will not be repeated, recall that as indicated previously, since each bushing 71 is positioned between the arms 116 of the bracket 114, the arms 116 should be sufficiently long to allow the bushing 71 to fit between the pedestal 119 and the side surface 142 of the right frame member 126.

The first end 89 of the right frame member 126 is configured to receive the first end of 28 of the rear frame member 123. When the rear frame member 123 is received by the right frame member 126, the bores extending through the first end of the right frame member 126 are axially aligned with the bores extending through the first end of the rear frame member 123. A nut and bolt assembly 127 is inserted through these bores to secure the rear frame member 123 to the right frame member 126.

The second end 92 of the right frame member 126 is configured to receive the second end 29 of the front frame member 27. When the front frame member 27 is received by the right frame member 126, the bores 39 and 44 of the front frame member 27 are axially aligned with the bores extending through the second end of the right frame member 126. The right frame member 126 is secured to the front frame member 27 by a nut and bolt assembly 128 that is inserted through these bores.

A central frame member 129 extends between the front frame member 27 and the rear frame member 123. The central frame member 129 includes a first end 131. The first end 131 includes an L-shaped bracket 132 (FIG. 2B) that extends downward toward the base unit 16. A bore, not shown, extends through the bracket 132. Extending from the bracket 132 is an arm 133 that includes a bore 134. A bore, not shown, extends through the first end 131. A nut and bolt assembly 136 is inserted through the bore 36 of the top surface 31 of the front frame member 27 and the bore of the first end 131 to secure the central frame member 129 to the front frame member 27.

The central frame member 129 also includes a second end 137 that includes an L-shaped bracket 138. The bracket 138 extends downward toward the base unit 16. A bore, not shown, extends through the bracket 138. Extending from the bracket 138 is an arm 139 that includes a bore 141. A bore, not shown, extends through the second end 137 of the central frame member 129. The central frame member 129 is secured to the rear frame member 123 by a nut and bolt assembly 142 that is inserted through the bore of the second end 137 and the bore 118 that extends through the top surface 114 of the rear frame member 123.

A U-shaped bracket 143 (FIG. 2A) is welded to the mid-portion of the central frame member 129. The bracket 143 is oriented perpendicular to the central frame member 129. The bracket 143 includes first and second spaced apart arms 144 and 147 that extend downward toward the base unit 16. A bore 146 extends through the first arm 144 and a bore 148 extends through the second arm 147.

The frame 12 also includes a pair of central support beams 149 that extend between the front frame member 27 and the rear frame member 123. Each central support beam 149 has a first end 151 and a second end 152. Referring to FIG. 2B, the central support beams 149 are generally I-shaped and include a top surface 153 separated from a bottom surface 154 by a perpendicularly oriented connecting surface 156. A bore 157 (FIG. 2A) extends through the first end 151 of the top surface 153 of each central support beam 149. Extending through the top surface 153 at the second end 152 is a second bore 158 (FIG. 2A). A rectangular opening 159 (FIG. 2B) is included in the connecting surface 156 near the center of each central support beam 149.

A nut and bolt assembly 161 (FIG. 2A) is inserted through the bore 157 and the bore 38 of the front frame member 27 to secure the first end 151 of one central support beam 149 to the front frame member 27. Likewise, a nut and bolt assembly 162 is inserted through the bore 158 and the bore 38 of the rear frame member 123 to secure the second end 152 of the central support beam 149 to the rear frame member 123. The second central support beam 149 is attached to the front frame member 27 and the rear frame member 123 in a similar manner. Thus, a nut and bolt assembly 161 is inserted through the bore 157 and the bore 41 of the front frame member 27 to secure the first end 151 of the second support beam 149 to the front frame member 27. A nut and bolt assembly 162 is inserted through the bore 158 and the bore 41 of rear frame member 123 to secure the second end 152 of the second support beam 149 to the rear frame member 123.

Referring to FIG. 5, a counter-balance system 163 is provided in the pediatric stretcher 10. The counter-balance system 163 includes a first counter-balance assembly 164. The first counter-balance assembly 164 includes a spring 166. The spring 166 has a first end 167 in the form of a hook that is inserted through the bore 42 on the bottom surface 32 of the front frame member 27. A second end 168 of the spring 166, also in the form of a hook, is attached to a clevis 171. The clevis 171 is included within a block and tackle assembly 169. The clevis 171 has spaced apart arms 172 through which extend a bore. A nut and bolt assembly 209 is inserted through the bore of the arms 172.

The block and tackle assembly 169 also includes a first pulley 174 and a second pulley 176 that are secured to the clevis 171 by the nut and bolt assembly 209. The first and second pulleys 174 and 176 are coupled to a third pulley 177 by a cord 178. The third pulley 177 is suspended from the bracket 132 that extends downward from the first end 131 of the central frame member 129. In particular, a nut and bolt assembly extends through the bore, not shown, and through the center of the pulley 177 to attach the pulley 177 to the bracket 132. The cord 178, which is anchored to the bracket 132, first passes over and around the first pulley 174. From the first pulley 174, the cord 178 passes over and around the third pulley 177. From the third pulley 177, the cord 178 passes over and around the second pulley 176. The cord 178 continues from the second pulley 176 through the bore 134 of the arm 133 of the bracket 132. From here, the cord 178 continues around a pulley or other guide mechanism (not shown) contained within the flat portion 53 of the bracket 52 and extends downward through a bore in the bottom of the flat portion 53.

The counter-balance system 163 also includes a second counter-balance assembly 181. The second counter-balance assembly 181 is virtually identical to the first counter-balance assembly 164. Therefore, like reference numbers will be used to indicate like components. The second counter-balance assembly 181 includes a spring 166. A first end 167 of the spring 166 is attached to the bore 42 on the bottom surface 32 of the rear frame member 123. A second end 168 of the spring 166 is connected to a block and tackle assembly 169. In particular, the second end 168 is attached to a clevis 171. The block and tackle assembly 169 also includes three pulleys 174–177 between which extend a cord 178. The third pulley 177 is suspended from the bracket 138 that extends downward from the second end 137 of the central frame member 129. The cord 178 is anchored to the bracket 138 and wound between the pulleys 174–177 as described above, and continues from the second pulley 176 through the bore 141 of the arm 139 of the bracket 138.

The counter-balance system 163 also includes a third counter-balance assembly 182. Once again, the third counter-balance assembly 182 is identical to the first two assemblies 164 and 181. Thus, like reference numbers will be used for like components. The third counter-balance assembly 182 includes a spring 166 that extends through the opening 159 in the central support beam 149. A first end 167 of the spring 166 is inserted through the bore 146 of the bracket 143. A second end 168 of the spring 166 is connected to a block and tackle assembly 169 including a clevis 171 that is configured identically to clevis 171 described above. The block and tackle assembly 169 also includes three pulleys 174, 176 and 177 between which extend a cord 178. The third pulley 177 is suspended from the bracket 96 that extends downward from the center of the left frame member 88. The cord 178 is anchored to the bracket 96 and is wound between the pulleys 174–177 as described above, and continues from the second pulley 176 through the bore 101 of the second arm 99 of the bracket 96.

Finally, a fourth counter-balance assembly 183 is included in the counter-balance system 163. The fourth counter-balance assembly 183 is identical to the counter-balance assemblies 164, 181 and 182 described above. Therefore, like components will be called out with like reference numbers. A spring 166 is included in the fourth counter-balance assembly 183. The spring 166 extends through the opening 159 in the central support beam 149. A first end 167 of the spring 166 is inserted through the bore 148 of the bracket 143. A second end 168 of the spring 166 is connected to a block and tackle assembly 169 including a clevis 171 configured identically to clevis 171 described above. The block and tackle assembly 169 also includes three pulleys 174, 176 and 177 that are interconnected by the cord 178. The third pulley 177 is suspended from the bracket 96 that extends downward from the center of the right frame member 126. The cord 178 is anchored to the bracket 96 and wound between the pulleys 174–177 as described above, and continues from the second pulley 176 through the bore 101 of the second arm 99 of the bracket 96.

Returning to FIG. 1, the patient support deck 11 is supported by the frame 12. The patient support deck 11 is secured to the front frame member 27 and the rear frame member 123 by the brackets 34 attached to these frame members 27 and 123. The patient support deck 11 can be fixedly attached to the brackets 34 of the frame 12, such as by welding. Alternatively, the patient support deck 11 could be pivotally attached to one or more brackets 34 such as by a nut and bolt assembly. In the later case the head and/or foot ends of the patient support deck 11 could be elevated with respect to the frame 12. Positioned atop the patient support deck 11 is the mattress 15.

Figure 6:
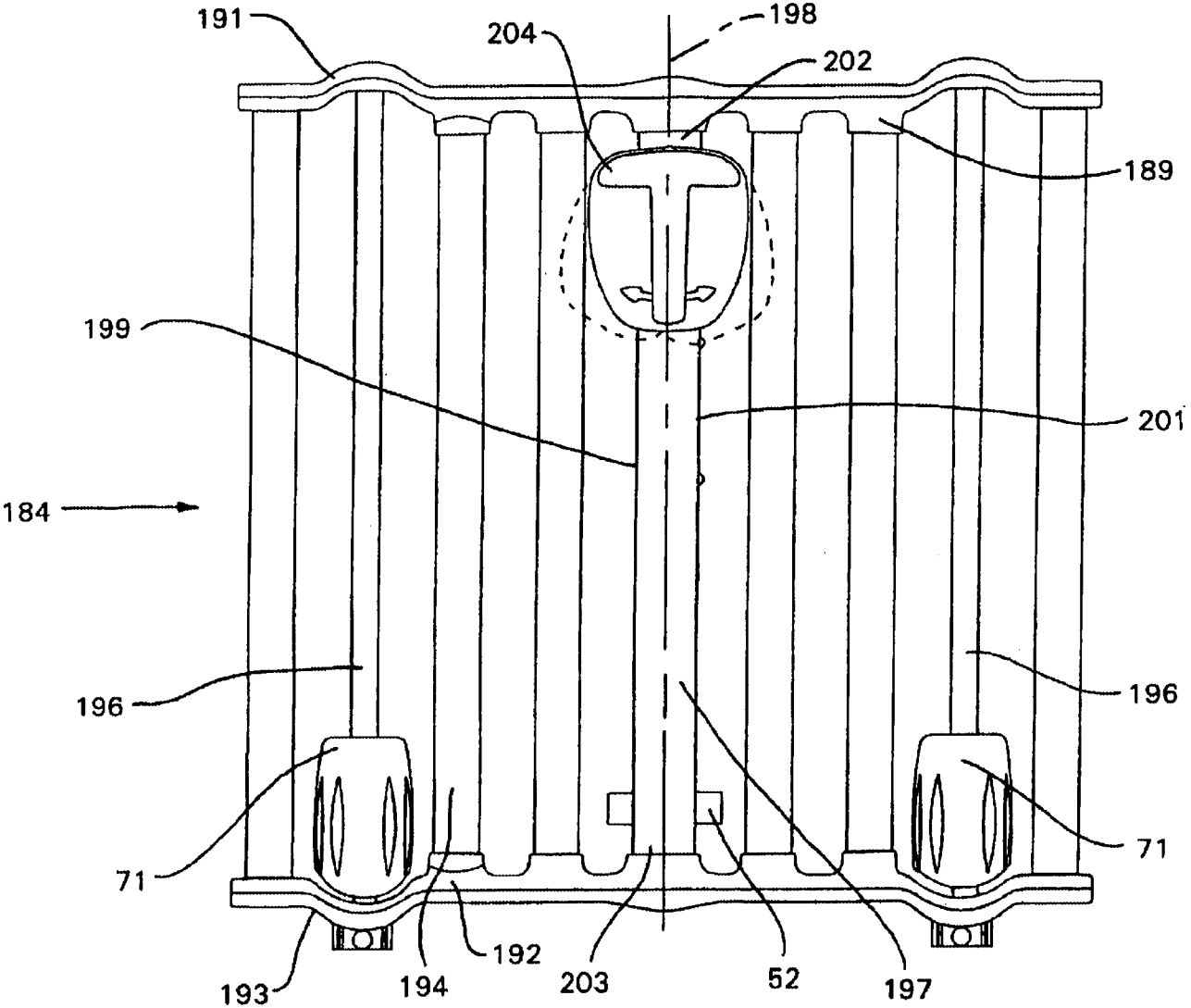
FIG. 6 is a front view of the left rail member of the pediatric stretcher of FIG. 1.

As depicted in FIG. 1, the patient support deck 11 and the mattress 15 are surrounded by a railing 14. The railing 14 includes four individual rail members. In particular, the railing 14 includes a left rail 184, a right rail 187, a front rail 186 and a rear rail 188. Each of the rails 184–188 is configured to be moved between a raised position and a lowered position, as described below. Referring now to FIG. 6, the left rail 184 includes a top rail component 189 and a bottom rail component 192. The top rail component 189 is generally planar, however, it includes two spaced apart elevated segments 191. Similarly, the bottom rail component 192 is also generally planar, and includes two spaced apart segments 193 that extend downward toward the base unit 16.

The top rail component 189 is separated from the bottom rail component 192 by a number of spindles 194. Included in these spindles 194 are a pair of guide spindles 196. Each guide spindle 196 is slidably received by one of the bushings 71. The guide spindle 196 is sized to be received by the opening 82 of the upper bracket 77 and the lower bracket 78. The guide spindle 196 is also sized to be in contact with the three rollers 81 on each of the upper bracket 77 and the lower bracket 78. In this manner, the guide spindle 196 can be guided by the bushing 71 to allow the left rail 184 to move steadily between its upper position and its lower position.

The raised segments 191 of the top rail component 189 and the extended segments 193 of the bottom rail component 192 are sized to accommodate the bushings 71. Therefore, when the left rail 184 is in the lower position, the upper end 72 of each bushing 71 will be flush with the planar segment of the top rail component 189. In other words, when the left rail 184 is in the lower position, the top rail component 189 will be adjacent the mattress 15.

As indicated above, the left rail 184 can be moved between an upper position and a lower position. The central spindle of the left rail 184 is a control spindle 197 that has a longitudinal axis 198. The control spindle 197 includes a left edge 199 and a right edge 201. A top end 202 of the control spindle 197 is attached to the top rail component 189 and a bottom end 203 is attached to the bottom rail component 192. A handle 204 is pivotally attached to the control spindle 197 adjacent the top end 202. The handle 204 is configured to pivot to the left and the right as indicated by the dashed lines in FIG. 6.

Attached to the bottom rail component 192 is the cord 178. The cord 178 extends downward from the bracket 52. The cord 178 extends through the bore in the bottom of the flat portion 53 of the bracket 52 and is coupled to the pulleys 174–177 of the block and tackle assembly 169, as described above. Thus, the left rail 184 will be connected to the third counter-balance assembly 182. Therefore, when the left rail 184 is moved between the upper position and the lower position, the effective weight of this rail member 184 can be minimized. The control spindle 197 is sized to slide within the bracket 52 that is attached to the left frame member 88 when the left frame member 88 is raised and lowered.

Figure 6B:
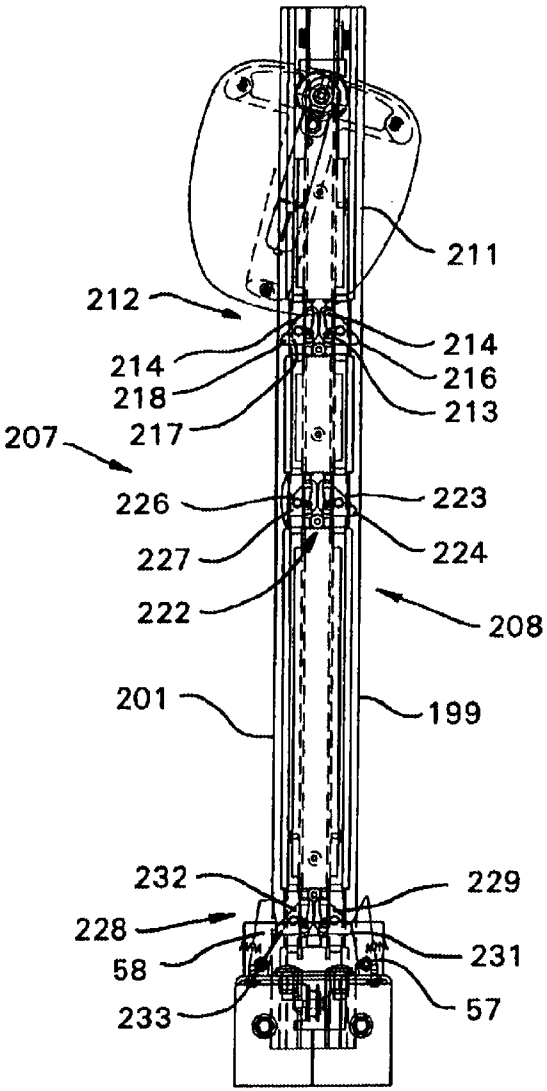
FIG. 6B is a rear cross-sectional view of the central spindle of the left rail member of FIG. 6 when the left rail member is in its uppermost position.
Figure 6A:
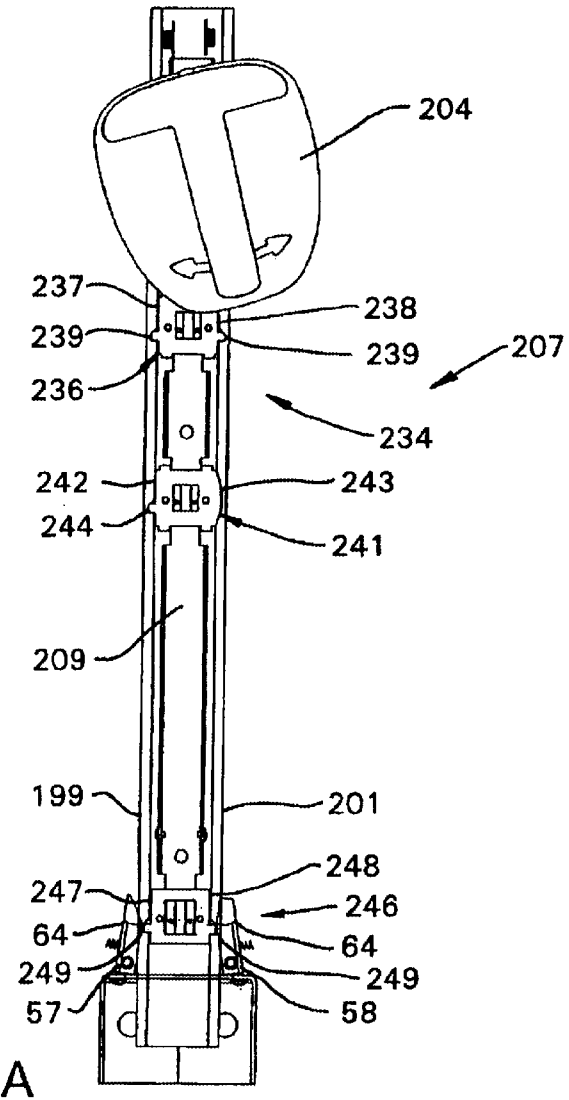
FIG. 6A is a front cross-sectional view of the central spindle of the left rail member of FIG. 6 when the left rail member is in its uppermost position.

Movement of the left rail 184 between its uppermost position and its lowermost position is facilitated by mechanisms incorporated into the control spindle 197. Referring to FIGS. 6A and 6B, a release and latching system 207 is integrated into the control spindle 197. The release and latching system 207 is configured to allow the left rail 184 to be moved between its uppermost position, a first intermediate position, a second intermediate position, and its fully lowered position. Preferably, when the left rail 184 is in its first intermediate position, the top rail component 189 is about fourteen inches above the mattress 15. When the left rail 184 in its second intermediate position, the top rail component 189 is preferably about nine inches above the mattress 15. When the left rail 184 is in its fully lowered position, the top rail component 189 is preferably flush with, or below, the top surface of the mattress 15.

The release and latching system 207 has been illustrated in FIGS. 6A and 6B when the left rail 184 is in its uppermost position. The release and latching system 207 includes a release sub-system 208 (FIG. 6B) that extends along the outer-facing side 209 of the control spindle 197. The release sub-system 208 includes three winged units that are spaced along the longitudinal axis 198 of the control spindle 197.

The winged units include a first winged unit 212 that is positioned adjacent the top end 202 of the control spindle 197. The first winged unit 212 includes a left triangular wing member 213 and a right triangular wing member 217. The left wing member 213 and the right wing member 217 can pivot between an expanded position (FIG. 6B) and a contracted position. Each wing member 213 and 217 is coupled to the release handle 204 such that when the handle 204 is turned, the wings 213 and 217 will expand. When the handle 204 is returned to its central position, the wings 213 and 217 will contract. The left and right wing members 213 and 217 pivot about a pivot axis that passes through a top corner 214 and of each member 213 and 217. When the left and right wing members 213 and 217 are in their expanded positions, outer corners 216 and 218 of each wing member 213 and 217 are adjacent the left and right edges 199 and 201 of the control spindle 197, respectively.

The release sub-system 208 also includes a second, central winged unit 222 that is configured similar to the first winged unit 212. The second wing unit 222 includes a left wing member 223 and a right wing member 226 that can pivot between an expanded position and a contracted position. As with the first winged unit 212, the wing members 223 and 226 of the second winged unit 222 are configured to pivot to their expanded positions when the handle 204 is turned. The left wing member 223 of the second unit 222 is a triangular member, identical to the left wing member 213 of the first unit 212. Thus, when the left wing member 223 is in its expanded position, an outer corner 224 of this member 223 is adjacent the left edge 199 of the control spindle 197. However, the right wing member 226 is only a partial triangle. When the right wing member 226 is in its expanded position, an outer edge 227 of this member does not extend to the right edge 201 of the control spindle 197.

Finally, the release sub-system 208 includes a third winged unit 228 that is positioned near the bottom end 203 of the control spindle 197. The third winged unit 228 is identical to the first winged unit 212. Thus, this unit 228 includes a left triangular wing member 229 and a right triangular wing member 232 that can pivot between an expanded position and a contracted position. The third winged unit 228 is configured such that when the handle 204 of the control spindle 197 is turned, the left and right wing members 229 and 232 will contract. When the wing members 229 and 232 are in the expanded position, an outer corner 231 and 233 of each member 229 and 232 is adjacent the respective edge 199 and 201 of the control spindle 197.

Referring now to FIG. 6A, the release and latching system 207 also provides a latching sub-system 234 that extends longitudinally along an inner-facing side 211 of the control spindle 197, opposite the release sub-system 208. The latching sub-system 234 includes three disks that are spaced longitudinally along the control spindle 197. The disks include a first disk 236 adjacent the top end 202 of the control spindle 197. The first disk 236 has a left edge 237 that is adjacent the left edge 199 of the control spindle 197 and a right edge 238 adjacent the right edge 201 of the control spindle 197. Both the left and right edges 237 and 238 are generally planar surfaces. A notch 239 projects from both the left edge 237 and the right edge 238 near the bottom of the first disk 236. The first disk 236 is positioned behind the first winged unit 212 along the control spindle 197. Thus, the notches 239 on the left and right edges 237 and 238 are positioned behind the outer corners 216 and 218 of the left and right wing members 213 and 217 of the first winged unit 212 when these wing members 213 and 217 are in their expanded positions.

The latching sub-system 234 also includes a second, central disk 241. The second disk 241 is similar to the first disk 236 and has a left edge 242 and a right edge 243, both of which are generally planar surfaces. A notch 244 protrudes from the left edge 242 of the second disk 241. The second disk 241 is positioned behind the second winged unit 222 along the control spindle 197. Therefore, the notch 244 on the left edge 242 is positioned behind the corner 224 of the left wing member 223 of the second winged unit 222 when this wing member 223 is in its expanded position.

Also included in the latching sub-system 234 of the control spindle 197 is a third disk 246 that is adjacent the bottom end 203 of the control spindle 197. The third disk 246 is identical to the first disk 236. Thus, the third disk 246 has a left edge 247 and a right edge 248, both of which are generally planar surfaces. Protruding from both the left edge 247 and the right edge 248 are notches 249. The third disk 246 is positioned behind the third winged unit 228 along the control spindle 197. The notches 249 are positioned on the left and right edges 247 and 248 such that when the third winged unit 228 is in its expanded configuration, the notches 249 will be behind the outer corners 231 and 233 of the left and right wing members 229 and 232.

When the left rail 184 is in its upper position the left notch 249 of the third disk 246 rests on the ledge 64 of the left latch 57 in the bracket 52. The right notch 249 of the third disk 246 rests on the ledge 64 of the right latch 58 of the bracket 52. When the handle 204 is turned, the left and right wing members of the winged units 212, 222, and 228 will expand. When the left and right wing members 229 and 232 of the third winged unit 228 expand, the left and right latches 57 and 58 are moved outward against the urging of the springs 66. Once the left and right latches 57 and 58 have been moved outward, the notches 249 of the third disk 246 no longer rest on the left and right ledges 64. Since the third disk 246 is no longer blocked by the left and right latches 57 and 58, the control spindle 197 can slide downward with respect to the bracket 59. Thus, the left rail 184 can be lowered.

As the control spindle 197 slides downward, the left and right wing members 229 and 232 of the third winged unit 228 move out of contact with the left and right latches 57 and 58. The left and right latches 57 and 58 are then moved back to their biased position by the urging of the springs 66. If the handle 204 is returned to the central position while the left rail 184 is being lowered between its upper position and its first intermediate position, the left and right wing members of the winged units 212, 222 and 228 will contract. When the central portion of the control spindle 197 slides into the bracket 59, the ledge of the left latch 57 will be in a position to engage the notch 244 on the left edge 242 of the second disk 241. The control spindle 197 will no longer be able to slide downward through the bracket 52. Thus, the left rail 184 will be stopped in the first intermediate position.

Figure 7B:
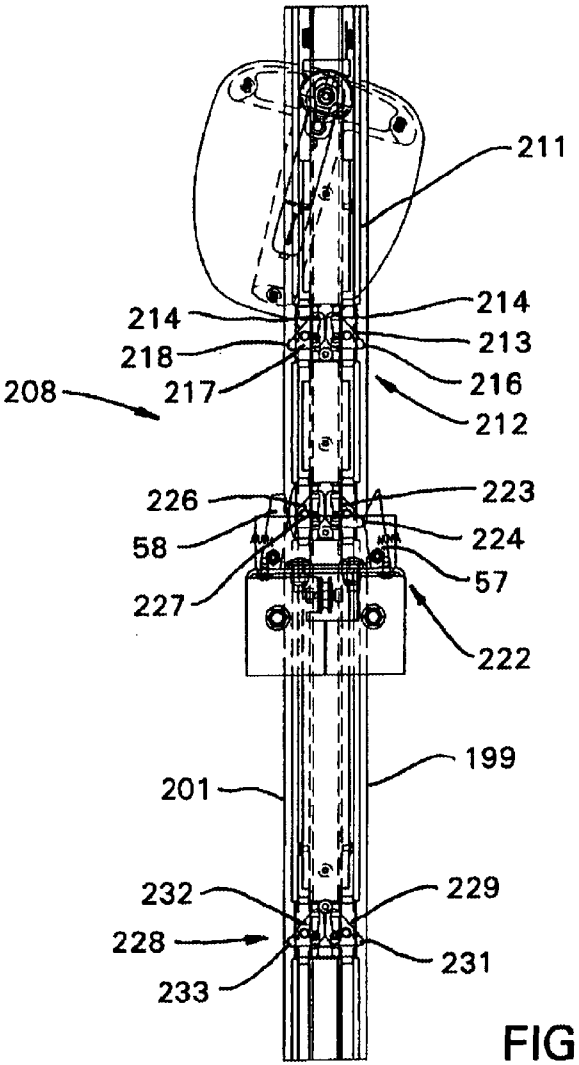
FIG. 7B is a rear cross-sectional view of the central spindle of the left rail member of FIG. 6 when the left rail member is in its first intermediate position.
Figure 7A:
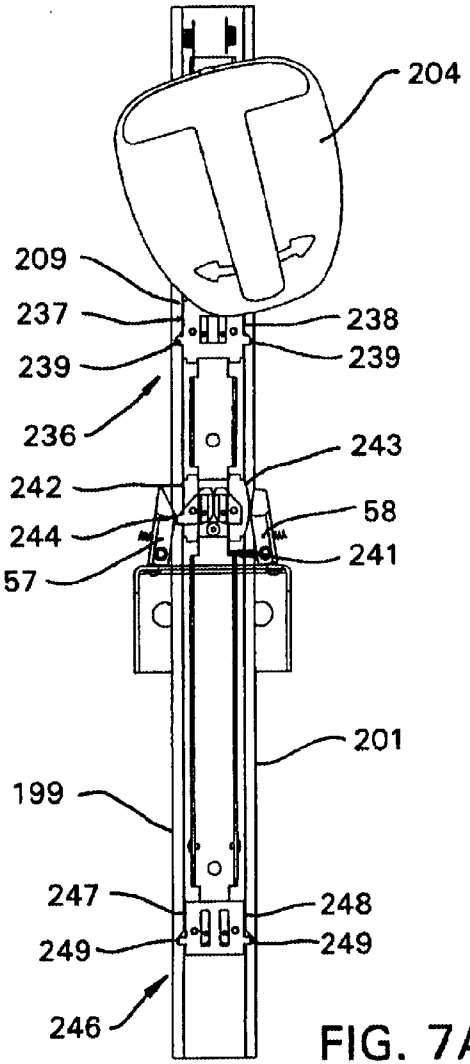
FIG. 7A is a front cross-sectional view of the central spindle of the left rail member of FIG. 6 when the left rail member is in its first intermediate position.

Referring now to FIGS. 7A and 7B, if the handle 204 is maintained in a pivoted position when the left rail 184 is sliding downward from its upper position, the winged units 212, 222 and 228 will remain in their expanded orientations. When the central portion of the control spindle 197 passes through the bracket 52, the left wing 223 of the second winged unit 222 will engage the left latch 57. The left latch 57 will therefore be moved outward against the bias of the spring 66. With the left latch 57 is moved outward, the left notch 244 of the second disk 241 will not be blocked by the ledge 64 of the left latch 57. Recall that the right wing 226 of the second winged unit 222 is not sufficiently sized to engage the right latch 58. However, since there is no notch protruding from the right edge 243 of the second disk 241, the right latch 58 will not be engaged by the second disk 241.

Figure 8B:
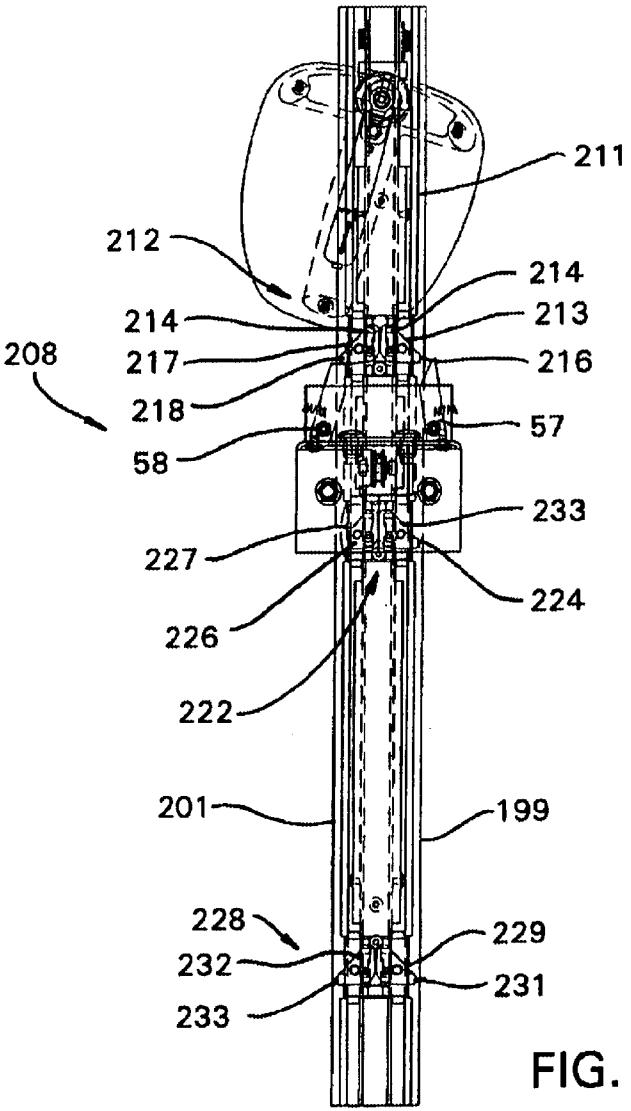
FIG. 8B is a rear cross-sectional view of the central spindle of the left rail member of FIG. 6 when the left rail member is in its second intermediate position.
Figure 8A:
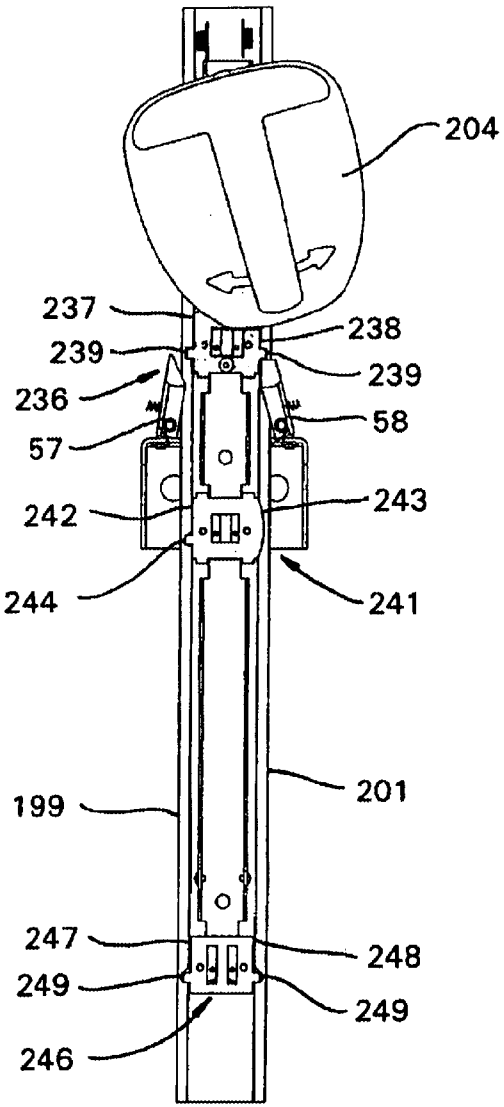
FIG. 8A is a front cross-sectional view of the central spindle of the left rail member of FIG. 6 when the left rail member is in its second intermediate position.

As the control spindle 197 slides downward, the left wing member 223 of the second winged unit 222 moves out of contact with the left latch 57. Referring now to FIGS. 8A and 8B, if the handle 204 is returned to the central position once the left rail 184 moved past the first intermediate position, the left and right wing members of the winged units 212, 222 and 228 will contract. As the control spindle 197 moves through the bracket 52, the notches 239 on the first disk 236 will be blocked by the ledges 64 on the left and right latches 57 and 58. Thus, the left rail 184 will be stopped in the second intermediate position.

If the handle 204 is not returned to the central position once the left rail 184 moves past the first intermediate position, the first winged unit 212 approaches the left and right latches 57 and 58. Since the right wing member 217 of the first winged unit 212 is in its expanded position, it will be blocked by the top portion 59 of the right latch 58. When the right wing member 217 comes to rest on the top portion 59 of the right latch 58, the control spindle 197 will no longer be able to slide through the bracket 59. Thus, the left rail 184 will be stopped in the second intermediate position.

To disengage the right wing member 217 from the right latch 58, the handle 204 must be returned to its central position. When the handle 204 is returned, the wing members of the winged units 212, 222, 228 will be returned to their contracted positions. When the right wing member 217 of the first winged unit 212 contracts, the control spindle 197, and thus the left rail 184, can slide downward. However, the downward movement is slight, as the notches 239 on the left and right edges 237 and 238 of the first disk 236 will be blocked by the ledges 64 on the left and right latches 57 and 58.

Returning to the left rail 184, to lower the left rail 184 to its fully lowered position, the handle 204 must be turned. When the handle 204 is turned, the left and right wing members of the winged units 212, 222 and 228 expand. When the left and right wing members 213 and 217 of the first winged unit 212 expand, the left and right latches 57 and 58 are moved outward against the urging of the springs 66. With the left and right latches 57 and 58 are moved outward, the notches 239 on the first disk 236 are no longer blocked by the ledges 64. The control spindle 197 can therefore slide downward through the bracket 59, and the left rail 184 can be lowered to its fully lowered position.

To raise the left rail 184 to the upper position or the first or second intermediate positions, the handle 204 does not need to be turned. To stop the left rail 184 in one of the elevated positions, the left rail 184 can then be eased up and down until the notch, or notches, of one of the disks 236, 241 or 246 rests on the ledge, or ledges, of the left and right latches 57 and 58. Since the second disk 241 only has a notch 244 on the left edge 242, it should be appreciated that left rail 184 is not quite as secure in its first intermediate position as when it is in its other positions.

Returning to FIG. 1, the railing 14 includes the front rail 186. The front rail 186 includes a number of components that are virtually identical to those included on the left rail 184. Therefore, a detailed description for these components will not be provided again. Like reference numbers will be used to describe like components.

Figure 9:
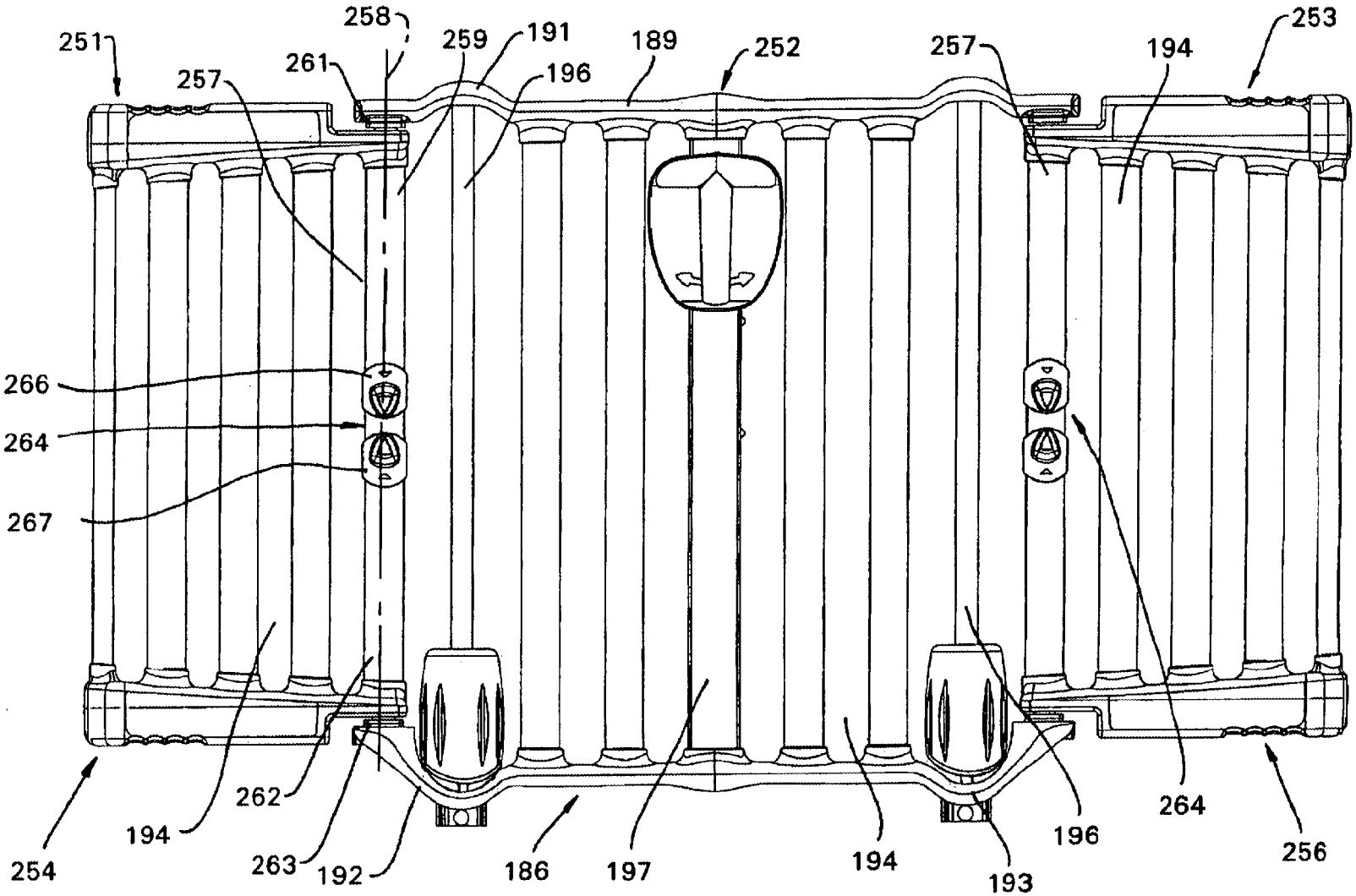
FIG. 9 is a front view of the front rail member of the pediatric stretcher of FIG. 1 with the left gate in an closed position.

Referring now to FIG. 9, the front rail 186 includes a left rail portion 251, a central rail portion 252 and a right rail portion 253. As depicted in FIG. 1, the left portion 251 of the front rail 186 is not connected to, or in contact with, the left rail 184. Wires and/or tubes connected to a patient can therefore pass between the front rail 186 and the left rail 184 when the child is removed from, or returned to, the pediatric stretcher 10. Similarly, a gap exists between the right rail portion 253 of the front rail 186 and the right rail 186, to allow tubes and/or wires to pass between the first rail 186 and the right rail 187. Thus, when a caregiver places a child in the stretcher 10, or removes a child from the stretcher 10, any tubes or wires connected to the patient do not need to be removed. Alternatively, since these gaps are present, the caregiver does not need to lower a rail or open a gate in order to avoid disconnecting any tubes or wires attached to the child.

As best illustrated in FIG. 9, the left rail portion 251 is a left gate 254 and the right rail portion is a right gate 256. Because the left gate 254 and the right gate 256 are virtually identical, only the left gate 254 will be described in detail. The left gate 254 includes a hollow pivot spindle 257 that has a pivot axis 258. The pivot spindle 257 has a top end 259 that is attached to the top rail component 256 by a hinge 261. A bottom end 262 of the pivot spindle 257 is attached to the bottom rail component 192 by a hinge 263. Positioned on the first pivot spindle 257 is a release handle 264. The release handle 264 allows an operator to unlock and open the gate 256. The release handle 264 includes a first button 266 and a second button 267.

Figure 10A:
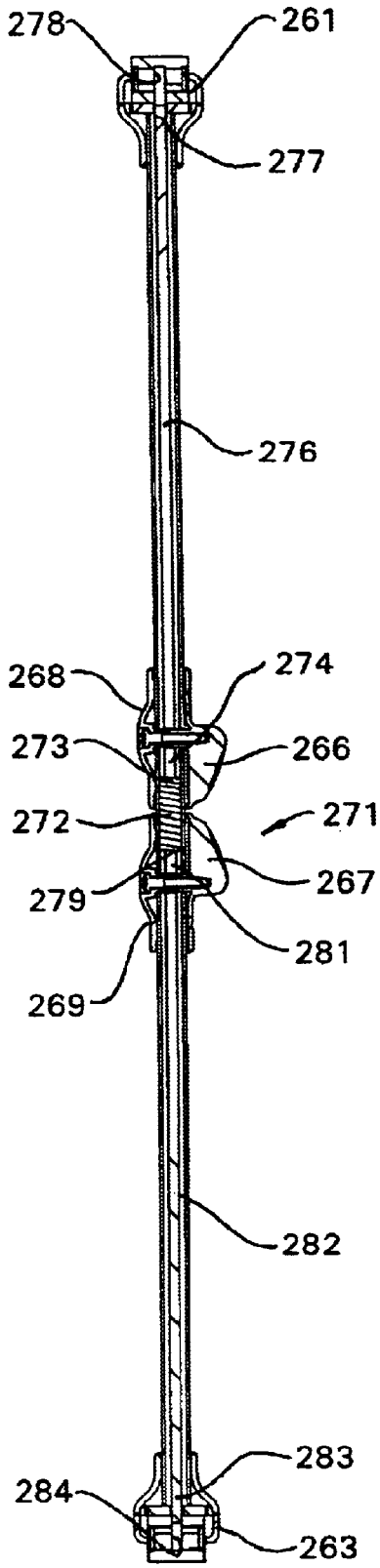
FIG. 10A is a cross-sectional view of the pivot spindle of the left gate of FIG. 10.
Figure 10:
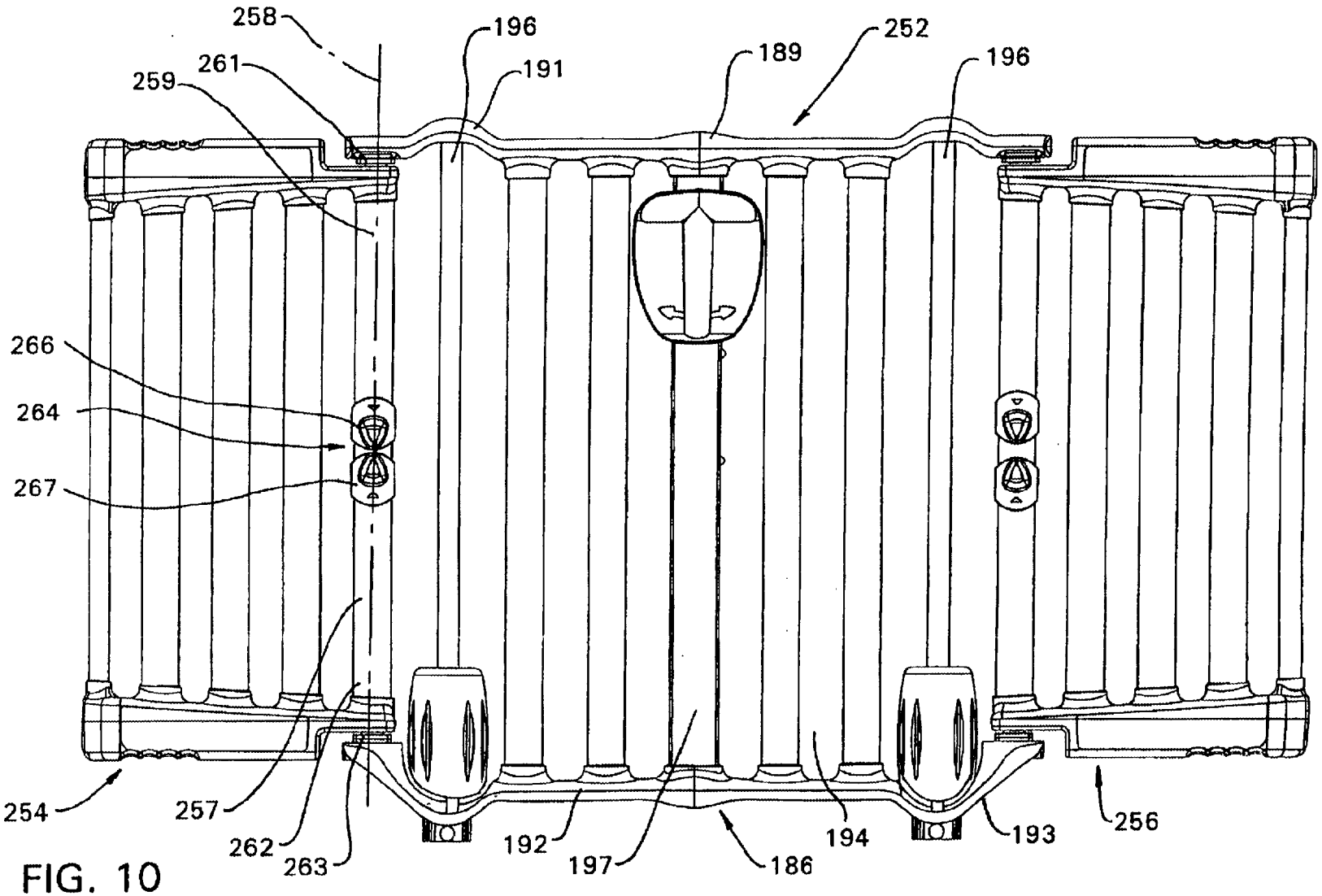
FIG. 10 is a front view of the front rail member of the pediatric stretcher of FIG. 1 with the release handle of the left gate in an open position.

The first button 266 and the second button 267 are movable along the pivot axis 258 between a first, spaced apart position (FIG. 9) and a second position in which the buttons 266 and 267 are in contact (FIG. 10). The first button 266 includes a bracket portion 268 that extends into the pivot spindle 257. Likewise, the second button 267 includes a bracket portion 269 that extends into the pivot spindle 257.

Figure 9A:
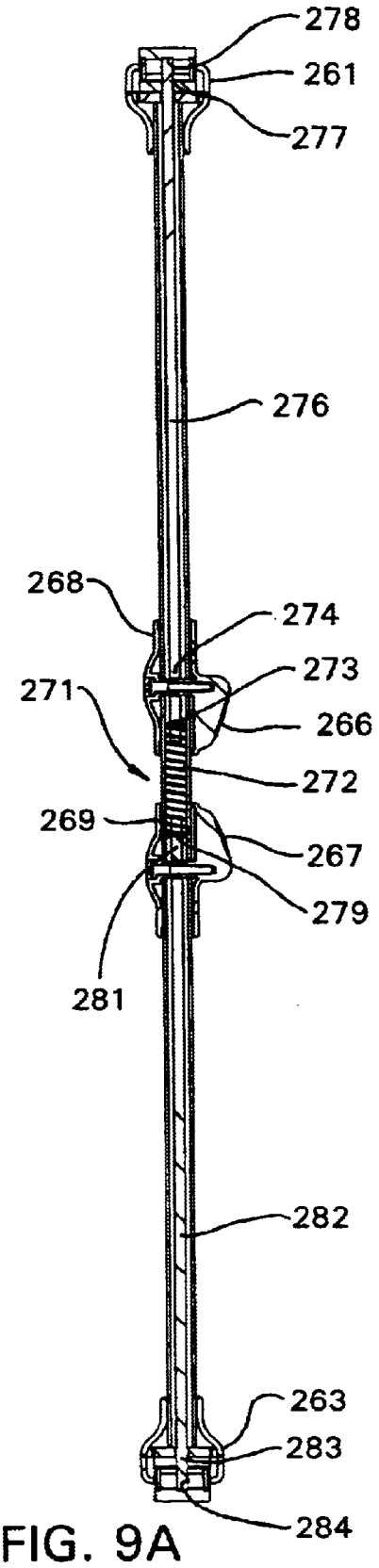
FIG. 9A is a cross-sectional view of the pivot spindle of the left gate of FIG. 9.

Referring in addition to FIGS. 9A and 10A, a release mechanism 271 is incorporated into the interior of the pivot spindle 257. The release mechanism 271 includes a spring 272 that extends along the pivot axis 258 of the pivot spindle 257. A first end 273 of the spring 272 is connected on to a lower end 283 of a first rod 276. The first rod 276 is oriented along the pivot axis and has an upper end 277 that is configured to be received in a pocket 278 in the top rail component 189 (FIG. 9A). The first rod 276 is urged by the spring 272 toward a position in which the upper end 277 is seated in the pocket 278. The first rod 276 is received by the bracket portion 268 of the first button 266. The first rod 276 is securely attached to the bracket portion 268, allowing the first button 266 and the first rod 276 to move in unison. Thus, when the first button 266 is moved toward the second button 267 along the pivot axis 258, the first rod 276 will be moved downward against the urging of the spring 272. If the first button 266 is moved downward a sufficient distance, the upper end 277 will be pulled out of the pocket 278 (FIG. 10A).

A second end 279 of the spring 272 is connected to an upper end 281 of a second rod 282. The second rod 282 is oriented along the pivot axis 258 and has a lower end 283 that is configured to be received in a pocket 284 (FIG. 9A). The second rod 282 is received by the bracket portion 269 of the second button 267. The second rod 282 is securely attached to the bracket portion 269, such that the second rod 282 and the second button 267 move in unison. Therefore, when the second button 267 is moved upward toward the first button 266, the second rod 282 will be moved upward against the urging of the spring 272. If the second button 267 is moved upward a sufficient distance, the lower end 283 of the second rod 282 will be removed from the pocket 284 (FIG. 10A).

Each hinge 261–263 is configured to prevent the left gate 254 from pivoting if the respective rod 276, 282 is seated in the corresponding pocket 278, 284. In order for the gate 254 to be opened, both the first rod 276 and the second rod 282 must be pulled out of the pockets 278 and 284 simultaneously. Thus, for the gate 254 to be opened, a user must simultaneously move the buttons 266 and 267 toward each other. When both the first rod 276 and the second rod 282 are pulled out of their respective pockets 278 and 284, as depicted in FIG. 10A, the gate 254 can be pulled open by the user. However, the buttons 266 and 267 are preferably sized and positioned such that an adult can unlock the gate 254 using one hand.

As indicated previously, the right gate 256 is virtually identical in configuration and operation to the left gate 254. Therefore, a detailed description of this component will not be provided.

Returning to the front rail 186, the central portion 252 includes a top rail component 189 that is separated from a bottom rail component 192 by a number of spindles 194. The spindles 194 include a pair of guide spindles 196. Each guide spindle 196 is guided by a bushing 71 to allow smooth, even movement of the right rail 186 between the upper position and the lower position. The spindles 194 also include a hollow control spindle 197. Disposed within the control spindle 197 is a release and latching system, described above for the left rail 184, that allow the front gate 187 to be raised and lowered.

As described for the left rail 184, the cord 178 passes from the block and tackle assembly 169 through the flat portion of the bracket 52 and downward along the control spindle 197 to the bottom rail component 192. The front rail member 186 is therefore connected to the first counter-balance assembly 164. Thus, when the front rail member 186 is raised or lowered, the effective weight of this component can be reduced.

Returning to FIG. 1, the railing 14 includes the right rail 187. The right rail 187 is virtually identical to the left rail 184. Therefore, a detailed description of this component will not be provided. The reference numbers used to describe the various components of the right rail 187 are the same as the reference numbers used to describe the like components of the left rail 184.

The right rail 187 includes a top rail component 189 that is separated from a bottom rail component 192 by a number of spindles 194. The spindles 194 include a control spindle 197 and a pair of guide spindles 196. Each guide spindle 196 is guided by a bushing 71 to facilitate smooth, even movement of the right rail 186 between the upper position and the lower position. The inner mechanisms of the control spindle 197 facilitate movement of the right rail 187 between the upper position and the lower position. The cord 178 passes from the block and tackle assembly 169 through the flat portion of the bracket 52 and downward along the control spindle 197 to the bottom rail component 192. The right rail member 187 is therefore connected to the fourth counter-balance assembly 183. Thus, when the right rail member 186 is raised or lowered, the effective weight of this component can be reduced.

Returning now to FIG. 1, the fourth component of the railing 14 is the rear rail 188. The rear rail 188 is virtually identical to the front rail 186. Therefore, a detailed description of this component will not be provided. The reference numbers used to describe components of the rear rail 188 are the same as the reference numbers used to describe the like components of the front rail 186.

The rear rail 188 includes a left rail portion 251, a central portion 252 and a right rail portion 253. As with the front rail 186, the left rail portion 251 and the right rail portion 253 are a left gate 264 and a right gate 266. Each gate 264 and 266 is locked and released about its pivot axis 258. The rear rail 188 is movable between an upward position and a lower position.

A top rail component 189 of each of the left, central and right portions 251–253 are separated from a bottom rail component 192 by a number of spindles 194. The spindles 194 of the central portion 252 include a control spindle 197 and a pair of guide spindles 196. Each guide spindle 196 is guided by a bushing 71. The control spindle 197 includes mechanisms that control movement of the rear rail 188 between the upper position and the lower position. The cord 178 passes from the block and tackle assembly 169 through the flat portion of the bracket 52 and downward along the control spindle 197 to the bottom rail component 192. The rear rail member 188 is therefore connected to the second counter-balance assembly 181. Thus, when the rear rail member 186 is raised or lowered, the effective weight of this component can be reduced.

As indicated with respect to the front rail 186, the left portion 251 of the rear rail 188 is not in contact with the left rail 184. Similarly, the right portion 253 of the rear rail 188 is not in contact with the right rail 186. Therefore, any tubes and/or wires connected to a patient can pass between these rail components when the patient is being returned to, or removed from the stretcher.

Figure 11:
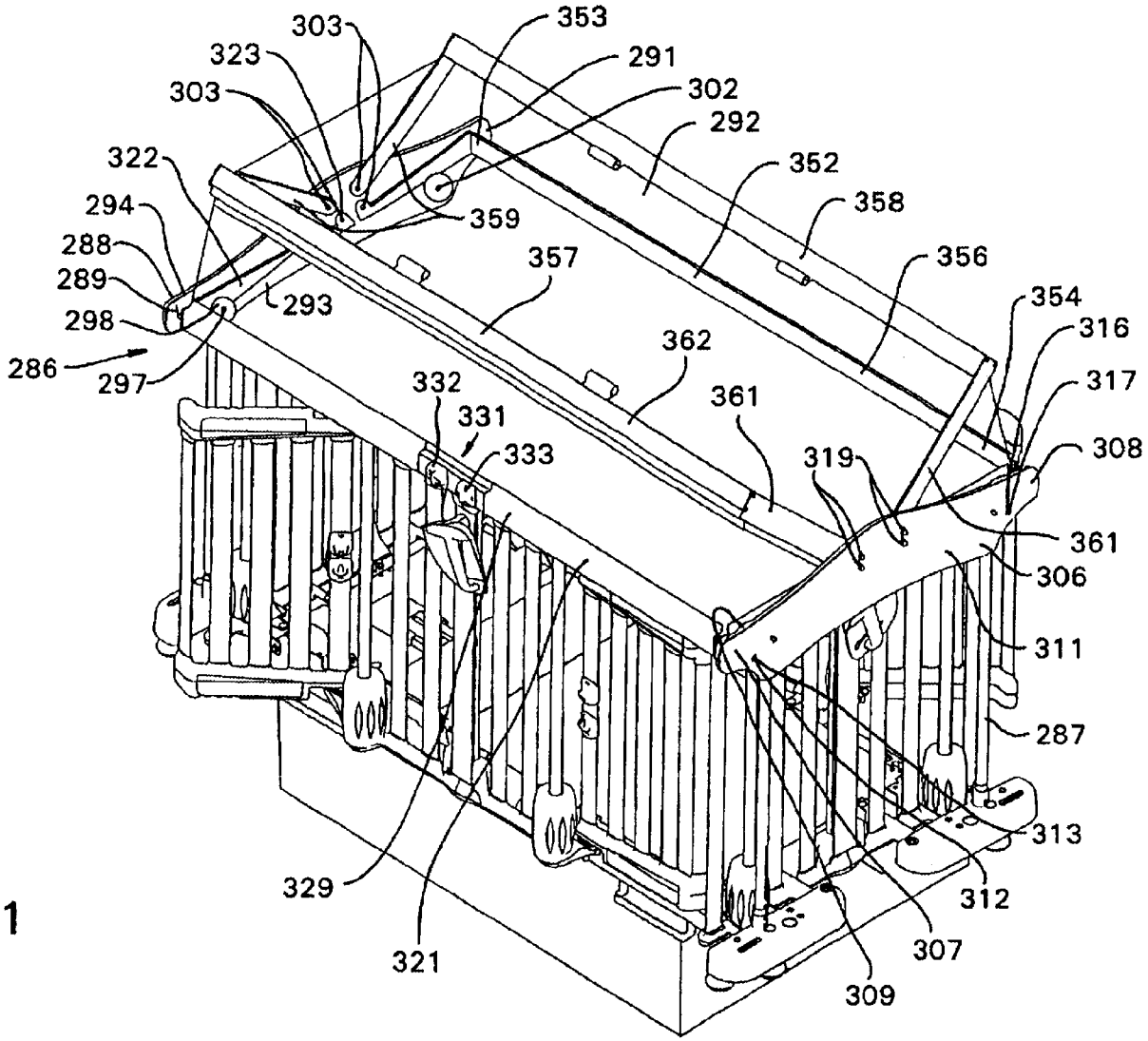
FIG. 11 is an isometric view of the pediatric stretcher of FIG. 1 including a canopy.

Referring now to FIG. 11, a canopy 286 can be attached to the pediatric stretcher 10. The canopy 286 is supported by four posts 287, each of which can be received by one of the bores 121 in the four pedestals 119. The canopy 286 includes a left base member 288 having a first end 289 and a second end 291. A clear cover 292 composed of vinyl or another suitable plastic is securely attached to the canopy 286. A first post 287 extends downward from the first end 289 of the left base member 288 and a second post 287 extends downward from the second end 291. The left base member 288 has an inner-facing side 293 and an outer-facing side 294. A number of bores extend through the left base member 288. In particular, a first bore (not shown) extends through the first end 289 of the left base member 288. A nut and bolt assembly 297 is inserted through the first bore. The nut and bolt assembly 297 is also inserted through a stop member 298 that is adjacent the inner facing surface 293 of the left base member 288.

A second bore (not shown) extends through the second end 291 of the left base member 288. A nut and bolt assembly is inserted through the second bore and attaches a stop member 302 adjacent the inner facing surface 293 of the left base member 288. Two pairs of longitudinally aligned bores 303 extend through the left base member 288 near the center of the left base member 288. As illustrated, the first pair of bores 303 is disposed just to the left of the mid-point of the left base member 288, while the second pair of bores 303 is disposed just to the right of the mid-point.

The canopy 286 includes a right base member 306 that is oriented parallel to the left base member 288. The right base member 306 is virtually identical to the left base member 288. Extending downward from the right base member 306 are two of the posts 287. As described previously, lower ends of the posts 287 are supported by the pedestals 119 attached to the right frame member 126. The right base member 306 has a first end 307 and a second end 308. The right base member 306 has an inner-facing surface 309 and an outer-facing surface 311. Extending through the first end 307 of the right base member 306 is a first bore 312. A nut and bolt assembly 313 is inserted through the first bore 312 and attaches a stop component (not shown) to the inner-facing surface 309 of the right base member 306. A second bore 316 extends through the second end 308 of the right base member 306. A nut and bolt assembly 317 is inserted though the second bore 316 and attaches a stop component (not shown) to the inner-facing surface 309 of the right base member 306. Two pairs of longitudinally aligned bores 319 extend through the right base member 306 near the mid-point of the right base member 306. A first pair of the bores 319 are located just to the left of the mid-point of the right base member 306. A second pair 319 of the bores 306 is located just to the right of the mid-point.

Four support rods extend between the left base member 288 and the right base member 306. A first support rod 321 extends between these base members and is positioned above the top rail component 189 of the front rail 186. The first support rod 321 is generally U-shaped and includes a left portion 322 that is separated from a right portion (not shown) by a hollow central portion 329. The left portion 322 terminates in an hook shaped end piece 323. Extending through the end piece 323 is a bore. A nut and bolt assembly extends through the bore of the end piece and the lower bore of the longitudinal bores 303 of the left base member 288 to pivotally connect the first support rod 321 to the left base member 288. The left portion 322 of the first support rod 321 is sized to be supported by the stop component 302.

The right portion (not shown) also terminates in a hook shaped end piece, through which extends a bore. A nut and bolt assembly extends through the bore of the end piece and the lower bore of the longitudinal bores 319 of the right base member 306 to pivotally connect the first support rod 321 to the right base member 306. Therefore, the first support rod 321 can pivot between a lowered, closed, position and an upper, open, position with respect to the left and right base members 288 and 306. The right portion of the first support rod 321 is sized to be supported by the stop component on the first end of the right base member 288.

Figure 11A:
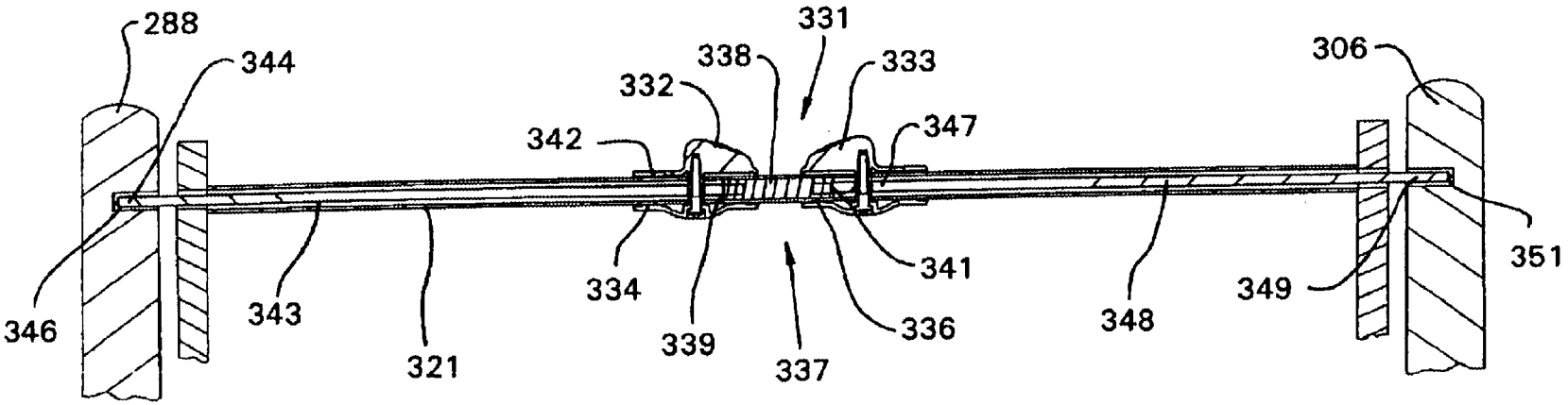
FIG. 11A is a cross-sectional view of the first support member of the canopy of FIG. 11.

A release handle 331 is positioned on an outer-facing surface of the central portion 329. The release handle 331 includes a first button 332 and a second button 333 that are slidably positioned on the central portion 329. The first button 332 and the second button 333 are movable between a first, spaced apart position (FIG. 11) and a second position. As illustrated in FIG. 11*a*, the first button 332 includes a bracket portion 334 that extends into the central portion 329 of the first support rod 321. Likewise, the second button 333 includes a bracket portion 336 that extends into the central portion 329.

A release mechanism 337 is incorporated into the central portion 329 to facilitate pivoting of the first support rod 321. The release mechanism 337 includes a spring 338 having a first end 339 and a second end 341. The first end 339 of the spring 338 is connected to a first end 342 of a first rod 343. A second end 344 of the first rod 343 is configured to be received in a pocket 346 in the left base member 288. The first rod 343 is urged by the spring 338 toward a position in which the second end 344 is seated in the pocket 346. The first rod 342 is fit securely within the bracket portion 334 of the first button 332. Therefore, the first button 332 and the first rod 342 will move in unison. In other words, when the first button 332 is moved toward the second button 333, the first rod 342 will be moved against the urging of the spring 338. If the first button 332 is moved a sufficient distance, the second end 344 will be pulled out of the pocket 346.

The second end 341 of the spring 338 is connected the first end 347 of a second rod 348. A second end 349 of the second rod 348 is configured to be received in a pocket 351 in the right base member 306. The second rod 348 is fit securely within the bracket portion 336 of the second button 333, such that the second rod 348 and the second button 333 move in unison. Therefore, when the second button 333 is moved toward the first button 332, the second rod 348 will be moved against the urging of the spring 338. If the second button 333 is moved a sufficient distance, the second end 349 of the second rod 348 will be removed from the pocket 351.

In order for the first support rod 321 to be unlatched, both the first rod 342 and the second rod 348 must be pulled out of the pockets 346 and 351. Thus, a user must simultaneously move the buttons 332–333 toward each other. When both the first rod 342 and the second rod 348 are pulled out of their respective pockets 346 and 351, the first support rod 342 can be pivoted to open the canopy 286, thus making the interior of the pediatric stretcher 10 accessible. The buttons 332–333 are preferably sized and positioned such that an adult can open the canopy 286 with one hand.

Returning to the canopy 286, a second support rod 352 extends between the left base member 288 and right base member 306. The second support rod 352 includes a left portion 353 that is separated from a right portion 354 by a hollow central portion 356. The second support rod 352 is identical to the first support rod 321 in both configuration and operation, and therefore, a detailed description will not be provided.

The canopy 286 also includes a first central support rod 357 and a second central support rod 358 that extend between the left base member 288 and the right base member 306. Each of the central support rods 357–358 is generally U-shaped and includes a left portion 359 that is separated from a right portion 361 by a central portion 362. The left portion 359 of each of the central support rods 357–358 includes an end, through which is defined a bore. A nut and bolt assembly is inserted through the bore of the left end and the respective upper bore 303 of the left base member 288 to pivotally attach the central support rods 357–358 to the left base member 288. The right portion 361 of the each of the central support rods 357–358 includes an end, through which is defined a bore. A nut and bolt assembly extends through the bore of the right end and the respective upper bore 319 of the right base member 306 to pivotally attach each of the central support rods 357–358 to the right base member 306.

The central support rods 357–358 can be pivoted when either the first or the second support rods 321, 352 are opened. Thus, the canopy 286 can be fully collapsed to allow a caregiver to have full access to the pediatric stretcher 10, when desired. The buttons 332–333 of each release handle 331 are sized and positioned to prevent a patient within the crib 10 from opening the canopy 286. However, the buttons 332–333 are also preferably sized and configured to allow an average adult to open the canopy 286 with only one hand.

It should be appreciated that the foregoing description is for the purposes of illustration only, and further alternative embodiments of this invention are possible without departing from the scope of the claims. For instance, the pediatric stretcher 10 of this invention has been illustrated having front and rear rail members 186, 188 that include a left gate 254 and a right gate 256. However, the rail members 186, 188 could instead include only one gate on either the left or right sides, or could include one or two central gates.

Thus, although particular preferred embodiments of the present invention have been disclosed in detail for illustrative purposes, it will be recognized that variations or modifications lie within the scope of the present invention and do not depart from the spirit of the invention, as set forth in the foregoing description and drawings, and in the following claims.

We claim:

1. A pediatric stretcher comprising:

a base unit including at least one support assembly;

a frame mounted on said at least one support assembly;

a patient support deck supported on said frame;

a railing surrounding said patient support deck and coupled to said frame by a plurality of coupling members;

said railing including first and second, spaced apart generally parallel rail members and third and fourth spaced apart generally parallel rail members, wherein said third and fourth rail members are oriented perpendicular to said first and second rail members, wherein said first rail member has a first end adjacent said third rail member and a second end adjacent said fourth rail member, and further wherein said first end is out of contact with said third rail member and said second end is out of contact with said fourth rail member, and said second rail member has a third end adjacent said third rail member and a fourth end adjacent said fourth rail member, and further wherein said third end is out of contact with said third rail member and said fourth end is out of contact with said fourth rail member;

at least one of said first, second, third and fourth rail members being configured to be elevationally adjusted with respect to said patient support deck and said plurality of coupling members;

at least one of said first, second, third and fourth rail members including a gate which is pivotally supported for movement about a pivot axis; and said gate being configured to be locked and released along said pivot axis.

2. The pediatric stretcher of claim 1, including a counterbalance system coupled to and between said frame and said at least one of said first, second, third and fourth rail members configured to be elevationally adjusted with respect to said patient support deck.

3. The pediatric stretcher of claim 1, wherein said gate includes a pivot spindle, and further wherein said pivot axis extends longitudinally along said pivot spindle; and a release mechanism is coupled to said pivot spindle and is adjustable between a locked position in which said gate is prevented from pivoting about said pivot axis and a release position in which said gate is capable of pivoting about said pivot axis.

4. The pediatric stretcher of claim 3, wherein said release mechanism includes first and second buttons;

said first button being connected to a first release assembly movably positioned in said pivot spindle and said second button being connected to a second release assembly movably positioned in said pivot spindle; and said release mechanism is in said locked position when said first and second buttons are spaced apart by a first distance and said release mechanism is in said release position when said first and second buttons are spaced apart by a second distance, wherein said first distance is greater than said second distance.

5. The pediatric stretcher of claim 4, wherein said first rail member has a first end including a first pocket and a second end including a second pocket;

said first button is attached to a first bracket portion movably positioned in said pivot spindle and said second button is attached to a second bracket portion movably positioned in said pivot spindle;

said first release assembly includes a first rod which is received in said first bracket portion and has a first rod end configured to be received in said first pocket;

said second release assembly includes a second rod which is received in said second bracket portion and has a second rod end configured to be received in said second pocket;

said first rod end is positioned in said first pocket and said second rod end is positioned in said second pocket when said release mechanism is in said locked position; and said first rod end is out of said first pocket and said second rod end is out of said second pocket when said release mechanism is in said release position.

6. The pediatric stretcher of claim 4, wherein said gate comprises a first gate, said pivot spindle comprises a first pivot spindle, said pivot axis comprises a first pivot axis and said release mechanism comprises a first release mechanism;

at least one of said first, second, third and fourth rail members includes an additional gate and an additional pivot spindle;

an additional pivot axis extends longitudinally along said additional pivot spindle; and an additional release mechanism is coupled to said additional pivot spindle and is configured to be adjustable between a locked position in which said additional gate is prevented from pivoting about said additional pivot axis and a release position in which said additional gate is capable of pivoting about said additional pivot axis.

7. The pediatric stretcher of claim 6, wherein said additional release mechanism includes third and fourth buttons which extend from said additional pivot spindle, and further wherein said third button is operatively connected to a third release assembly movably positioned in said additional pivot spindle and said fourth button is operatively connected to a fourth release assembly movably positioned in said second pivot spindle; and said additional release mechanism is in said locked position when said third and fourth buttons are spaced apart by a first distance and said additional release mechanism is in said release position when said third and fourth buttons are spaced apart by a second distance, wherein said first distance is greater than said second distance.

8. The pediatric stretcher of claim 1, wherein said plurality of coupling members includes at least one first, second, third and fourth bushing members;

said first rail member includes at least one first spindle that is guided in said at least one first bushing member;

said second rail member includes at least one second spindle that is guided in said at least one second bushing member;

said third rail member includes at least one third spindle that is guided in said at least one third bushing member; and said fourth rail member includes at least one fourth spindle that is guided in said at least one fourth bushing member.

9. The pediatric stretcher of claim 1, wherein each of said at least one of said first, second, third and fourth rail members configured to be elevationally adjusted includes a control spindle; and a handle extends outward from said control spindle and is connected to a release and latching system at least partially positioned in said control spindle.

10. The pediatric stretcher of claim 9, wherein said release and latching system includes a release sub-system and a latching sub-system, and further wherein said handle is rotated to control said release sub-system and said latching sub-system.

11. The pediatric stretcher of claim 10, wherein said release sub-system includes a plurality of winged units which are spaced apart along a longitudinal axis of said control spindle; and each of said plurality of winged units includes at least one wing member which contracts when said handle is rotated.

12. The pediatric stretcher of claim 1, wherein said first rail member includes a first release and latching system configured to allow said first rail member to be elevationally adjusted between a raised position and a lowered position;

said second rail member includes a second release and latching system configured to allow said second rail member to be elevationally adjusted between a raised position and a lowered position;

said third rail member includes a third release and latching system configured to allow said third rail member to be elevationally adjusted between a raised position and a lowered position; and said fourth rail member includes a fourth release and latching system configured to allow said fourth rail member to be elevationally adjusted between a raised position and a lowered position.

13. The pediatric stretcher of claim 12, wherein said first rail member includes a first control spindle, and further wherein a first handle extends outward from said first control spindle and is connected to said first release and latching system, said first release and latching system being at least partially positioned in said first control spindle;

said second rail member includes a second control spindle, and wherein a second handle extends outward from said second control spindle and is connected to said second release and latching system, said second release and latching system being at least partially positioned in said second control spindle;

said third rail member includes a third control spindle, and wherein a third handle extends outward from said third control spindle and is connected to said third release and latching system, said third release and latching system being at least partially positioned in said third control spindle; and said fourth rail member includes a fourth control spindle, and wherein a fourth handle extends outward from said fourth control spindle and is connected to said fourth release and latching system, said fourth release and latching system being at least partially positioned in said fourth control spindle.

14. A pediatric stretcher comprising:

a base unit including at least one support assembly;

a frame mounted on said at least one support assembly;

a patient support deck supported on said frame;

a railing surrounding said patient support deck and coupled to said frame by a plurality of coupling members;

said railing including first, second, third and fourth rail members;

at least one of said first, second, third and fourth rail members being configured to be elevationally adjusted with respect to said patient support deck and said plurality of coupling members;

a counter-balance system coupled to and between said frame and said at least one of said first, second, third and fourth rail members configured to be elevationally adjusted with respect to said patient support deck, said counter-balance system including at least one counter-balance assembly having a spring with a first end coupled to said frame and a second end coupled to one end of a block and tackle assembly;

at least one of said first, second, third and fourth rail members including a gate which is pivotally supported for movement about a pivot axis; and said gate being configured to be locked and released along said pivot axis.

15. The pediatric stretcher of claim 14, wherein said counter-balance system is positioned beneath said patient support deck.

16. A pediatric stretcher comprising:

a base unit including at least one support assembly;

a frame mounted on said at least one support assembly;

a patient support deck supported on said frame;

a railing surrounding said patient support deck and coupled to said frame by a plurality of coupling members;

said railing including first, second, third and fourth rail members;

at least one of said first, second, third and fourth rail members being configured to be elevationally adjusted with respect to said patient support deck and said plurality of coupling members;

at least one of said first, second, third and fourth rail members including a gate which is pivotally supported for movement about a pivot axis; and a canopy having at least two support members, said canopy including:

a first elongate rod positioned adjacent a top surface of said first rail member and a second elongate rod positioned adjacent a top surface of said second rail member;

a first release handle coupled to said first elongate rod and configured to be adjustable between a locked position in which said first elongate rod is prevented from pivoting about a first longitudinal axis and a release position in which said first elongate rod is capable of pivoting about said first longitudinal axis; and a second release handle coupled to said second elongate rod and configured to be adjustable between a locked position in which said second elongate rod is prevented from pivoting about a second longitudinal axis and a release position in which said second elongate rod is capable of pivoting about said second longitudinal axis; and wherein said frame includes at least two pedestals configured to receive said at least two support members.

17. The pediatric stretcher of claim 16, wherein said first release handle is attached to a first release mechanism which is at least partially positioned within said first elongate rod;

said first release handle includes first and second buttons, wherein said first button is connected to a first release assembly movably positioned in said first elongate rod and said second button is connected to a second release assembly movably positioned in said first elongate rod; and said first release mechanism is in said locked position when said first and second buttons are spaced apart by a first distance and said first release mechanism is in said release position when said first and second buttons are spaced apart by a second distance, wherein said first distance is greater than said second distance.

18. The pediatric stretcher of claim 17, wherein said second release handle is attached to a second release mechanism which is at least partially positioned within said second elongate rod;

said second release mechanism includes third and fourth buttons, wherein said third button is connected to a third release assembly movably positioned in said second elongate rod and said fourth button is connected to a fourth release assembly movably positioned in said second elongate rod; and said second release mechanism is in said locked position when said third and fourth buttons are spaced apart by a third distance and said second release mechanism is in said release position when said third and fourth buttons are spaced apart by a fourth distance, wherein said third distance is greater than said fourth distance.

19. A pediatric stretcher comprising:

a base unit;

a frame supported by said base unit by a plurality of support members;

a patient support deck supported by said frame, the entirety of said frame being positioned below a plane defined by a top surface of a mattress placed on said support deck;

a railing surrounding said patient support deck, wherein said railing is coupled to said frame by a plurality of coupling members;

said railing including first, second, third and fourth rail members;

at least one of said first, second, third and fourth rail members being configured to be elevationally adjusted with respect to said patient support deck and said plurality of coupling members; and said at least one of said four rail members configured to be elevationally adjusted being coupled to a counter-balance system attached to said frame and positioned beneath the patient support deck, said counter-balance system including at least one counter-balance assembly having a first end coupled to said frame and a second end connected to a bottom rail component of said at least one of said four rail members so that no part of said counter-balance system extends upwardly beyond the plane defined by the top surface of said mattress.

20. The pediatric stretcher of claim 19, wherein said at least one counter-balance assembly includes a spring having a first end coupled to said frame and a second end coupled to one end of a block and tackle assembly.

21. The pediatric stretcher of claim 20, wherein each of the other first, second, third and fourth rail members is configured to be elevationally adjusted; and said counter-balance system includes counter-balance assemblies individually coupled to and between said frame and a respective one of said rail members.

22. The pediatric stretcher of claim 21, wherein said first rail member includes a first releasable locking assembly configured to allow said first rail member to be moved between a raised position and a lowered position;

said second rail member includes a second releasable locking assembly configured to allow said second rail member to be moved between a raised position and a lowered position;

said third rail member includes a third releasable locking assembly configured to allow said third rail member to be moved between a raised position and a lowered position; and said fourth rail member includes a fourth releasable locking assembly configured to allow said fourth rail member to be moved between a raised position and a lowered position.

23. The pediatric stretcher of claim 19, wherein each of said at least one of said first, second, third and fourth rail members are configured to be elevationally adjusted and each of said rail members includes a vertically oriented elongate control spindle and a handle that extends outwardly from said elongate control spindle and that is connected to a release and latching system at least partially positioned in said control spindle.

24. The pediatric stretcher of claim 23, wherein said first rail member has a first end adjacent said third rail member and a second end adjacent said fourth rail member, and further wherein said first end is out of contact with said third rail member and said second end is out of contact with said fourth rail member; and said second rail member has a third end adjacent said third rail member and a fourth end adjacent said fourth rail member, and further wherein said third end is out of contact with said third rail member and said fourth end is out of contact with said fourth rail member.

25. The pediatric stretcher of claim 19, wherein said first rail member includes a gate which is pivotally supported for movement about a pivot axis.

26. The pediatric stretcher of claim 19, wherein when said first, second, third and fourth rail members are in a lowered position, no part of said pediatric stretcher projects above the plane defined by the top surface of said mattress.

27. A pediatric stretcher comprising:

a base unit including at least one support assembly;

a frame mounted on said at least one support assembly;

a patient support deck supported on said frame;

a railing surrounding said patient support deck and coupled to said frame by a plurality of coupling members;

said railing including first and second spaced apart generally parallel rail members and third and fourth spaced apart generally parallel rail members, wherein said third and fourth rail members are oriented perpendicular to said first and second rail members;

said first rail member including a central portion, a first end portion and a second end portion, wherein said first end portion is adjacent to and out of contact with said third rail member and said second end portion is adjacent to and out of contact with said fourth rail member, so that a gap having a width is located between said first end portion of said first rail member and said third rail member; and said first portion comprising a gate which is pivotal with respect to said central portion about a pivot axis adjacent said central portion, said gate being configured to be opened to increase the width of the gap between said first rail member and said third rail member and provide increased access to a patient.

28. The pediatric stretcher of claim 27, wherein said gate comprises a first gate and said second end portion of said first rail member comprises a second gate which is pivotal about a second pivot axis adjacent said central portion to increase a width of a gap between said first rail member and said fourth rail member.

29. The pediatric stretcher of claim 27, wherein said second rail member includes a second central portion, a third end portion and a fourth end portion, wherein said third end portion is adjacent to and out of contact with said fourth rail and said fourth end portion is adjacent to and out of contact with said third rail; and said gate comprises a first gate and at least one of said third and fourth end portions comprises a second gate which is pivotal about a second pivot axis adjacent said second rail central portion, wherein said second gate is configured to be opened to increase the width of a gap between said second rail member and one of said third and fourth rail members.

30. The pediatric stretcher of claim 27, wherein said central portion includes a top rail and a bottom rail and a first end of said gate is pivotally connected to said central portion by a first hinge connected to said top rail and a second hinge connected to said bottom rail; and a second end of said gate projects outwardly toward the gap with said third rail member.

31. A pediatric stretcher comprising:

a base unit including at least one support assembly;

a frame mounted on said at least one support assembly;

a patient support deck supported on said frame;

a railing surrounding said patient support deck and coupled to said frame by a plurality of coupling members;

said railing including front, rear, left and right rail members, each of said front, rear, left and right rail members including a top rail;

a canopy supported by said frame and including first and second elongate rods which are adjacent said top rail of said left and right rail members, respectively and first and second base members which are adjacent said front and rear rail members, respectively;

a release handle coupled to said first elongate rod and configured to be adjustable between a locked position in which said first elongate rod is locked at facing sides of said first and second base members and a release position in which said first elongate rod is capable of pivoting about a longitudinal axis spaced therefrom;

said release handle is coupled to a release mechanism movably positioned at least partially within said first elongate rod, said release mechanism having a first mechanism end which extends into said first base member and a second mechanism end which extends into said second base member when said release handle is in said locked position; and said first and second mechanism ends are removed from said respective first and second base members when said release handle is in said release position.

32. The pediatric stretcher of claim 31, wherein an additional release handle is coupled to said second elongate rod and is configured to be adjustable between a locked position in which said second elongate rod is locked at facing sides of said first and second base members and a release position in which said second elongate rod is capable of pivoting about a second longitudinal axis spaced therefrom;

said additional release handle is coupled to an additional release mechanism movably positioned at least partially within said second elongate rod, said additional release mechanism having a third mechanism end which extends into said second base member and a fourth mechanism end which extends into said first base member when said additional release handle is in said locked position; and said third and fourth mechanism ends are removed from said respective second and first base members when said additional release handle is in said release position.

33. The pediatric stretcher of claim 31, wherein said release handle includes first and second buttons which extend from said first elongate rod; and said release handle is in said locked position when said first and second buttons are spaced apart by a first distance and said release handle is in said release position when said first and second buttons are spaced apart by a second distance, wherein said first distance is greater than said second distance.

* * * * *